US009309469B2

(12) United States Patent
Evans

(10) Patent No.: US 9,309,469 B2
(45) Date of Patent: Apr. 12, 2016

(54) APPARATUS AND METHOD FOR CONTROLLING OR ADDING MATERIAL TO ONE OR MORE UNITS

(75) Inventor: Martin Evans, Tolland, CT (US)

(73) Assignee: Johnson Matthey Process Technologies, Inc., Savannah, GA (US)

( * ) Notice: Subject to any disclaimer, the term of this patent is extended or adjusted under 35 U.S.C. 154(b) by 1492 days.

(21) Appl. No.: 12/892,421

(22) Filed: Sep. 28, 2010

(65) Prior Publication Data

US 2011/0073525 A1 Mar. 31, 2011

Related U.S. Application Data

(60) Provisional application No. 61/247,501, filed on Sep. 30, 2009.

(51) Int. Cl.
*G06Q 10/00* (2012.01)
*C10G 11/18* (2006.01)

(52) U.S. Cl.
CPC ..... *C10G 11/18* (2013.01)

(58) Field of Classification Search
CPC ..... C10G 11/187; C10G 2300/1033; C10G 2300/1011; C10G 11/18
USPC ..... 366/150.1, 152.2
See application file for complete search history.

(56) References Cited

U.S. PATENT DOCUMENTS 2,616,591 A 11/1952 Haugen
3,212,657 A 10/1965 Murfitt et al.
3,860,510 A 1/1975 Henke et al.
3,893,905 A 7/1975 Fenske et al.
3,980,441 A 9/1976 Wulf et al.
4,082,513 A 4/1978 Andon et al.
4,433,917 A * 2/1984 Mendel et al. ..... 366/132
4,578,366 A 3/1986 Cetinkaya et al.
4,660,881 A 4/1987 Komeya et al.
4,746,420 A * 5/1988 Darian et al. ..... 208/222
4,769,127 A 9/1988 Erickson et al.

(Continued)

FOREIGN PATENT DOCUMENTS

WO WO-2009020459 A2 2/2009

OTHER PUBLICATIONS

ADPI C-Engine, www.adpi.com/C-Engine.htm, printed Nov. 15, 2002.

(Continued)

*Primary Examiner* — Tony G Soohoo
(74) *Attorney, Agent, or Firm* — Kevin M. Carroll

(57) ABSTRACT

Material delivery systems and methods are disclosed. Material delivery system includes delivery vessel, metering device, dispense mechanism, and mixer. The delivery vessel is configured to dispense material to a unit and metering device provides a metric indicative of the dispensed material to the unit. The dispense mechanism is configured to couple the delivery vessel to the unit. The mixer is coupled to the delivery vessel and configured to sufficiently mix the material with an activating agent. The method includes dispensing metered material from a dispense mechanism of a delivery vessel coupled to a mixer, wherein a metric is indicative of the dispensed material to the unit; sufficiently mixing the metered material with an activating agent in the mixer to activate the material, the mixer coupled to the unit; and delivering the activated material to the unit via the mixer. Systems and method also include providing material to plurality of units.

7 Claims, 17 Drawing Sheets

(56) References Cited

U.S. PATENT DOCUMENTS

| | | | | |
|---|---|---|---|---|
| 4,782,427 | A | 11/1988 | Marks | |
| 4,809,883 | A | 3/1989 | Pozo | |
| 4,809,889 | A | 3/1989 | Friedman | |
| 4,815,042 | A * | 3/1989 | Pratt | 366/141 |
| 5,055,176 | A | 10/1991 | Herbst et al. | |
| 5,064,099 | A | 11/1991 | Iwako | |
| 5,286,370 | A | 2/1994 | Chu et al. | |
| 5,339,236 | A | 8/1994 | Tamagawa | |
| 5,389,236 | A | 2/1995 | Bartholic et al. | |
| 5,401,387 | A | 3/1995 | Harandi et al. | |
| 5,810,045 | A | 9/1998 | Evans | |
| 6,132,157 | A | 10/2000 | Comardo | |
| 6,300,467 | B1 | 10/2001 | Auer | |
| 6,342,199 | B1 | 1/2002 | Ellis | |
| 6,358,401 | B1 | 3/2002 | Evans | |
| 6,974,559 | B2 | 12/2005 | Evans | |
| 7,223,714 | B2 | 5/2007 | Beech, Jr. et al. | |
| 7,364,708 | B2 | 4/2008 | Evans | |
| 7,622,600 | B1 | 11/2009 | Marr | |
| 2001/0041117 | A1 | 11/2001 | Comardo | |
| 2003/0127358 | A1 | 7/2003 | Letzsch | |
| 2003/0175182 | A1 | 9/2003 | Teall et al. | |
| 2004/0138059 | A1 | 7/2004 | Euzen et al. | |
| 2004/0166032 | A1 | 8/2004 | Evans | |
| 2005/0103684 | A1 | 5/2005 | Evans | |
| 2005/0106079 | A1 | 5/2005 | Evans | |
| 2005/0106080 | A1 * | 5/2005 | Evans et al. | 422/139 |
| 2006/0074571 | A1 * | 4/2006 | Evans | 702/50 |
| 2006/0138028 | A1 | 6/2006 | Evans | |
| 2006/0147358 | A1 | 7/2006 | Evans | |
| 2006/0236595 | A1 | 10/2006 | Nakamura | |
| 2007/0130822 | A1 | 6/2007 | Araya | |
| 2007/0204506 | A1 | 9/2007 | Brenes | |
| 2008/0029432 | A1 * | 2/2008 | Elliott et al. | 208/106 |
| 2009/0110608 | A1 * | 4/2009 | Vierheilig et al. | 422/110 |
| 2009/0115434 | A1 | 5/2009 | Hirthe et al. | |
| 2009/0115436 | A1 | 5/2009 | Koehler, III et al. | |
| 2009/0131711 | A1 | 5/2009 | Wanasundara | |
| 2009/0183422 | A1 | 7/2009 | Wysong | |
| 2009/0291469 | A1 | 11/2009 | David | |
| 2010/0017312 | A1 | 1/2010 | Evans | |
| 2010/0105970 | A1 * | 4/2010 | Yanik et al. | 585/240 |
| 2010/0189706 | A1 | 7/2010 | Chang et al. | |
| 2010/0230324 | A1 | 9/2010 | Al-Alloush et al. | |
| 2010/0280301 | A1 * | 11/2010 | O'Connor | 585/639 |

OTHER PUBLICATIONS

PCT international search report and written opinion of PCT/US2010/050537 dated Jun. 28, 2011.

* cited by examiner

APPARATUS AND METHOD FOR CONTROLLING OR ADDING MATERIAL TO ONE OR MORE UNITS

CROSS-REFERENCE TO RELATED APPLICATION

This application claims priority to provisional application 61/247,501, filed Sep. 30, 2009, titled A METHOD AND APPARATUS FOR CONTROLLING OR ADDING MATERIAL TO ONE OR MORE UNITS.

BACKGROUND OF THE INVENTION

1. Field of the Invention

The invention generally relates to material delivery systems and methods of metering and delivering a material to one or more units. Particularly, the invention relates to material delivery systems and methods of metering or delivering or controlling one or more materials to one or more units with mixer to sufficiently mix material with activating agent to activate material.

2. Description of the Related Art

Some industrial processes, such as fluid catalytic cracking systems, dispense one or more specified amount of a material such as a catalyst(s) or additives to a single FCC unit. FIG. 1 is a simplified schematic of one embodiment of a conventional fluid catalytic cracking system 130. The fluid catalytic cracking system 130 includes a FCC unit 110 coupled to catalyst or additive addition system, etc. 100, oil feed stock source 104, an exhaust system 114 and a distillation system 116. Catalyst from the catalyst addition system 100 and oil from the oil feed stock source 104 are dispensed to the FCC unit 110.

The catalyst addition system 100 may include a main catalyst injector 102 and one or more additive injectors 106. The main catalyst injector 102 and the additive injector 106 are coupled to the FCC unit 110 by a process line 122. A fluid source, such as a blower or air compressor 108, is coupled to the process line 122 and provides pressurized fluid, such as air, that is utilized to carry the various products, such as a catalyst, additive, equilibrium spent catalyst, catalyst fines, etc. from the injectors 102, 106 through the process line 122 where they are combined with oil from the oil feed stock source 104 and dispensed into the FCC unit 110.

Catalyst added to an FCC unit are usually not wetted or activated. In contrast, catalyst added to a biofuel unit is usually wetted or i.e. activated catalyst. Currently, catalyst is wetted by either manually mixing the catalyst batch wise within a bucket, and emptying the bucket into the reactor, or adding the catalyst to a quantity of wetting agent in a stirring tank, where catalyst is agitated or mixed with wetting agent for a period before transferring the wetted catalyst to a reactor. Non-limiting disadvantages of current wetting methods include one or more factors such as inefficiency, safety, and labor intensiveness. For example, manual wetting method requires reactor to be opened to receive the catalyst which is a safety hazard. Non-limiting disadvantages of wetting catalyst in a stirred tank include one or more factors such as inefficient mixing, settling of the catalyst in the stirring tank, thus requiring addition system to be cleaned out frequently.

Therefore, a need exists for an apparatus and method for wetting or activating catalyst and adding such activated catalyst to one or more units.

SUMMARY OF THE INVENTION

The purpose and advantages of embodiments of the invention will be set forth and apparent from the description that follows, as well as will be learned by practice of the embodiments of the invention. Additional advantages will be realized and attained by the methods and systems particularly pointed out in the written description and claims hereof, as well as from the appended drawings.

Material delivery systems and methods of delivering one or more materials to one or more units are disclosed. Accordingly, one aspect of the invention includes a material delivery system. The material delivery system includes a delivery vessel, one or more metering devices, one or more dispense mechanism, and one or more mixers. The delivery vessel is configured to dispense material to at least one unit and a metering device provides a metric indicative of the dispensed material with respect to the at least one unit. The at least one dispense mechanism is configured to couple the delivery vessel to the at least one unit. The mixer is coupled to the delivery vessel and configured to sufficiently mix the material with an activating agent.

A second aspect of the invention includes a method of providing a material to at least one unit. The method includes dispensing a metered material from at least one dispense mechanism of a delivery vessel coupled to a mixer, wherein a metric is indicative of the dispensed material with respect to the at least a unit; sufficiently mixing the metered material with an activating agent in the mixer to activate the material, the mixer coupled to the at least one unit; and delivering the activated material to the at least one unit via the mixer.

A third aspect of the invention includes a method of providing a material to a plurality of units. The method includes dispensing a metered material from at least one dispense mechanism of a delivery vessel coupled to a mixer, wherein a metric is indicative of the dispensed material with respect to at lest one unit; sufficiently mixing the metered material with an activating agent in the mixer to activate the material, the mixer coupled to the plurality of units; and delivering the activated material to the plurality of units via the mixer.

The accompanying figures, which are incorporated in and constitute part of this specification, are included to illustrate and provide a further understanding of the method and system of the invention. Together with the description, the figures serve to explain the principles of the invention. It is contemplated that features from one embodiment may be beneficially incorporated in other embodiments without further recitation.

BRIEF DESCRIPTION OF THE DRAWINGS

To facilitate understanding, identical reference numerals have been used, wherever possible, to designate identical elements that are common to the figures.

DETAILED DESCRIPTION

Figure 1:
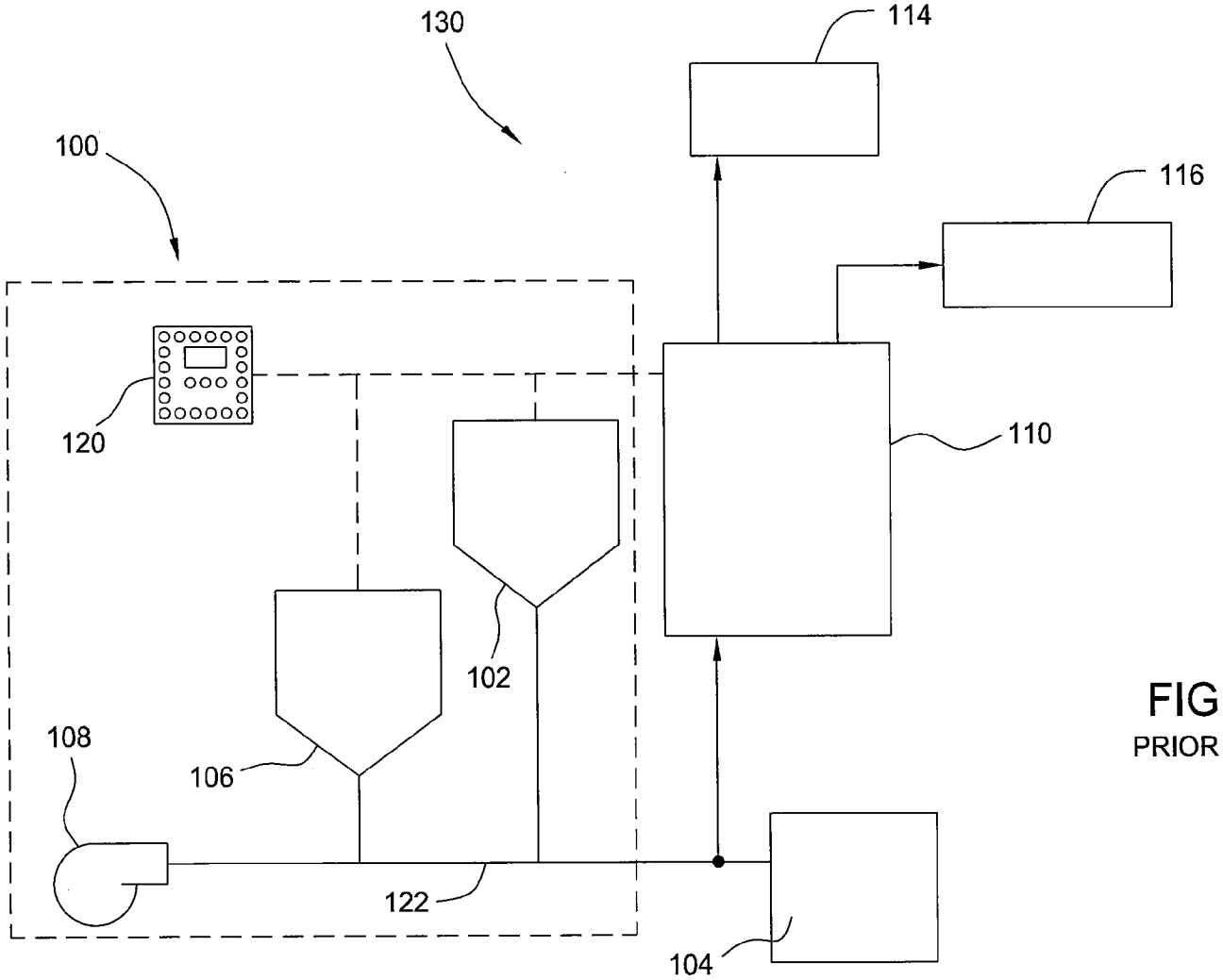
FIG. 1 PRIOR ART
FIG. 1 is schematic view of a conventional fluid catalytic cracking system.

Reference will now be made in detail to exemplary embodiments of the invention, which are illustrated in the accompanying figures and examples. Referring to the drawings in general, it will be understood that the illustrations are for the purpose of describing a particular embodiment of the invention and are not intended to limit the invention thereto.

Whenever a particular embodiment of the invention is said to comprise or consist of at least one element of a group and combinations thereof, it is understood that the embodiment may comprise or consist of one or more of any of the elements of the group, either individually or in combination with any of the other elements of that group. Furthermore, when any variable or part occurs more than one time in any constituent or in formula, its definition on each occurrence is independent of its definition at every other occurrence. Also, combinations of parts and/or variables are permissible only if such combinations result in stable apparatus, system or method. The invention provides material delivery systems and methods of metering and delivering material to one or more units.

Figure 2:
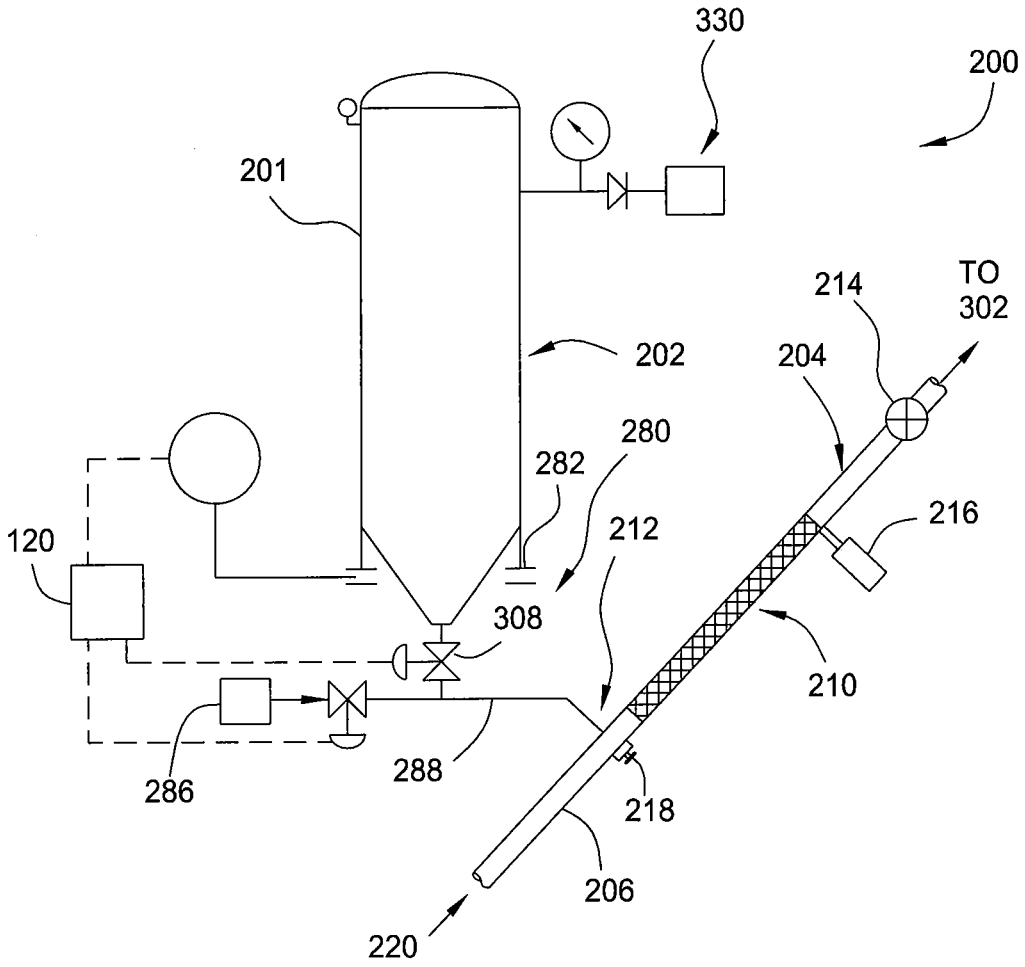
FIG. 2 is a schematic diagram of an embodiment of material delivery system.

FIG. 2 is a schematic diagram of an embodiment of a material delivery system 200 suitable for controlling and dispensing or providing activated material such as catalyst to one or more units 302. The material delivery system 200 includes one or more delivery vessels 201, one or more metering devices 308, one or more dispense mechanisms 280, and one or more mixers 204. The delivery vessel 201 is configured to dispense a metered amount of material to one or more units 302, wherein a metering device 308 provides a metric indicative of the dispensed material with respect to the one or more units 302. One or more dispense mechanisms 280 are configured to couple the delivery vessel 201 to the unit 302. The mixer 204 is coupled to the delivery vessel 201 and configured to sufficiently mix the material with an activating agent 220 prior to delivery of the material to the at least one unit 302.

In an embodiment, the dispense mechanism 280 includes the metering device 308 and one or more sensors 282 that in conjunction with the metering device 308, facilitate the dispensing (i.e., metering) of discrete known amounts of material, such as catalyst, from the delivery vessel 201 to the at least one unit 302 through the mixer 204. The dispense mechanism 280 is coupled to a control module 120, such as a PLC or other processor suitable for controlling dispense operations of the material delivery system 200. The control module 120 may optionally control the operation of the mixer 204. The sensor 282 provides a metric suitable for determining the amount of material passing through the metering device 308 during each transfer of material to and/or from the delivery vessel 201. Alternatively, the sensors 282 may be configured to detect the level (i.e., volume) of material in the delivery vessel 201, the weight of material in the delivery vessel 201, the rate of material movement through the delivery vessel 201, metering device 308, and/or a material delivery line 288 coupling the metering device 308 to the mixer 204.

In an embodiment, the sensor 282 includes a plurality of load cells adapted to provide a metric indicative of the weight of material in the delivery vessel 201. From sequential data samples obtained from the load cells, the control module 284 may resolve the net amount of transferred material after each actuation of the metering device 308. Additionally, the cumulative amount of material dispensed over the course of the production cycle may be monitored so that variations in the amount of material dispensed in each individual cycle may be compensated for by adjusting the delivery attributes of the metering device 308, for example, by changing the open time of a control valve to allow more (or less) material to pass there through and into the delivery vessel 201 for ultimate injection into the unit 302 through the mixer 204.

In another embodiment, the sensor 282 may be a level sensor (not shown) coupled to the delivery vessel 201 and adapted to detect a metric indicative of the level of material within the delivery vessel 201. The level sensor may be an optical transducer, a capacitance device, a sonic transducer or other device suitable for providing information from which the level or volume of material disposed in the delivery vessel 201 may be resolved. By utilizing sensed differences in the levels of material disposed within the delivery vessel 201 between dispenses, the amount of material dispensed may be resolved for a known storage vessel geometry.

In yet another embodiment, the sensor 282 may be a flow sensor (not shown) adapted to detect the flow of material through one of the components of the material delivery system 200 described herein. In one embodiment, the flow sensor may be a contact or non-contact device and may be mounted to the delivery vessel 201 or the dry material delivery line 288 coupling the delivery vessel 201 to the mixer 204. For example, the flow sensor may be a sonic flow meter or capacitance device adapted to detect the rate of entrained material (i.e., catalyst) moving through the material delivery line 288.

A pressure control device 330 is coupled to the delivery vessel 201 so that the delivery vessel 201 may be pressurized to facilitate material dispensing through the metering device 308 as further discussed below. The pressure control device 330 may provide nitrogen or other suitable gas(es) to the delivery vessel 201.

The metering device 308 is configured to couple the delivery vessel 201 to the unit. The metering device 308 is coupled between a discharge port of the delivery vessel 201 and the mixer to control the amount of material transferred from the delivery vessel 201 to the unit through the mixer 204. The metering device 308 may be a shut-off valve, rotary valve, mass flow control module, pressure vessel, flow sensor, positive displacement pump, or other device suitable for regulating the amount of material dispensed from the delivery vessel 201 for injection into the unit 302. Material exiting the metering device 308 in moved by a fluid provided by a fluid source 286, which provide shop air, air, clean dry air, Nitrogen or other suitable fluid for moving material through the material delivery line 288. A blower or compressor 108 may be used as the fluid source 286 if suitable for use with the particular materials being metered by the material delivery system 200.

In an embodiment, the mixer 204 is coupled to the delivery vessel 201 through the metering device 308 of the dispense mechanism 280 and is configured to sufficiently mix the material with an activating agent 220. In another embodiment, the mixer 204 is coupled to the dispense mechanism 280 and configured to sufficiently mix the material with an activating agent 220. In one embodiment, the delivery vessel 201 is configured to dispense a metered or known or otherwise measurable quantity with the metering device 308. In one embodiment, metering device 308 dispenses a known or otherwise measurable quantity of catalyst to the mixer 204. In one embodiment, Bartholic U.S. Pat. No. 5,389,236, which is incorporated by reference in its entirety may be adapted to benefit from the invention as described. Other suitable metering loaders that may be adapted to benefit from the invention are described in Ser. No. 11/283,227 filed Nov. 18, 2005, U.S. Pat. No. 6,974,559 issued Dec. 13, 2005, U.S. Pat. No. 7,364,708 issued Apr. 29, 2008, and U.S. Pat. No. 7,510,647 issued Mar. 31, 2009, etc., all of which are incorporated by reference in their entireties.

The material delivery systems are suitable for delivering various materials and embodiments of the invention are not limited by what the material is being dispensed or the form of the material being dispensed. Examples of compositions of material include but are not limited to alumina, silica, zirconia, aluminosilicates, hydrotalcites such as described in Applicant's U.S. Pat. No. 6,028,023 and precursors to hydrotalcites such as described in Applicant's U.S. Pat. No. 7,347,929 etc., either individually or in a combination of two or more thereof. Non-limiting examples of the form of material include liquid, powder, formed solid shapes such as microspheres, beads, and extrudates, either individually or in a combination of two or more forms. Materials may be referred as and include catalyst, product, powder, additive, equilibrium spent catalyst, and catalyst fines.

In an embodiment, the material delivery systems are configured to dispense material to one or more units 302 such as, but not limited to biofuels units, an FCC unit, fixed bed or moving bed unit, bubbling bed unit, units suitable for the manufacture of pyridine and its derivatives, units suitable for the manufacture of polypropylene, units suitable for the manufacture of polyethylene, units suitable for the manufacture of acrylonitrile, and other units suitable for industrial processes, etc., either individually or in a combination of two or more. In such embodiment, the delivery vessel may have an operational pressure of about 0 to about 6.9 barg. In such an embodiment, the delivery vessel has an operational pressure of about 0.3 to about 2.1 barg.

The mixer 204 may be positioned in-line with a conduit 206 that provides one or more activating agents 220 to activate material to be dispensed to the unit 302, as shown in FIG. 2. An embodiment of the mixer 204 includes one or more mixing elements 210 disposed in the conduit 206 between a material inlet 212 that provides material from the metering device to the unit 302. The material inlet 212 is coupled to the end of the material delivery line 288 to allow material exiting the delivery vessel 201 to enter the conduit 206 and be routed through the mixing elements 210 en route to the unit 302. The mixer 204 is configured to sufficiently mix the material and activation agent as desired prior to the material entering the unit 302. Non limiting examples of mixers 204 include one or more static mixer or baffles within the conduit 206, dynamic mixers, such as rotating vanes or paddles, driven by a motor 216 or other actuator, either and individually or in combination of two or more thereof.

Figure 3:
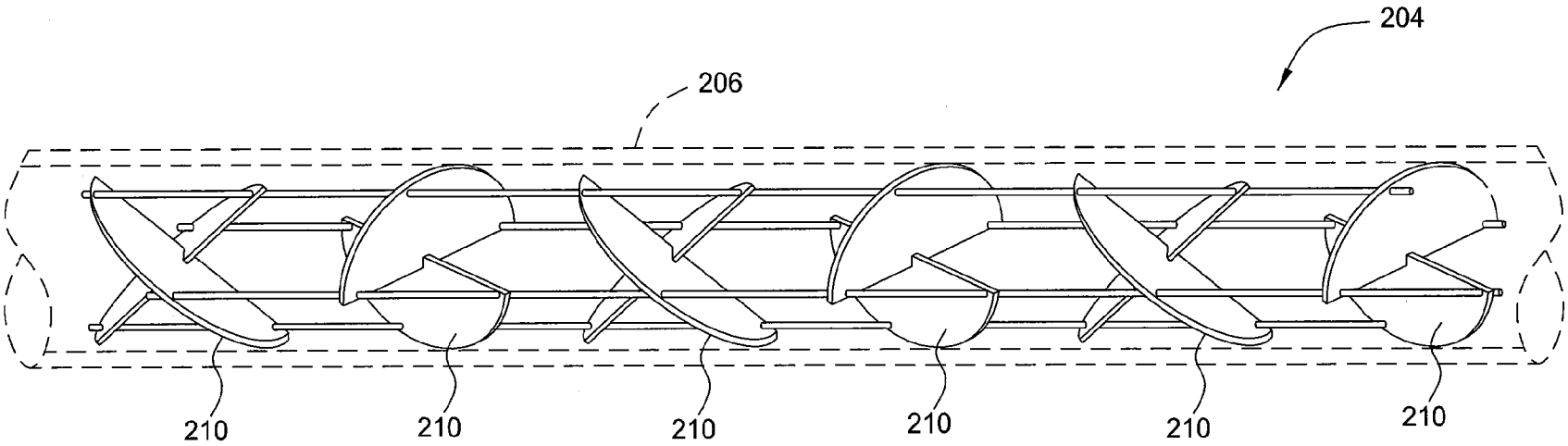
FIG. 3 is a schematic diagram of another embodiment of a material delivery system with a static mixer.

FIG. 3 is another schematic diagram of a static mixer 204 with one or more mixing elements 210. The mixer 204 may alternatively be a tube of sufficient length or have other features to add turbulence such that the catalyst has sufficient residence time and mixing to become activated. In an embodiment, the mixer may be a tube which provides a pressure drop of 3-5 psi.

In an embodiment, the mixer 204 includes a plurality of semi-elliptical plates (mixing elements 210) which are discriminately positioned in a tubular housing. An embodiment of mixing element 210 includes two plates perpendicular to each other.

Embodiments of the invention are not limited by the form, size or shape of the mixer 204 or mixing elements 210. The form, shape and size of the mixer 204 or mixing elements 210 may vary. Non-limiting examples of the shape of the mixer 204 or mixing elements 210 include sphere, elliptical, rectangular, circular, plate, cube, tripod, pyramid, rod, tetrapod, pleated or any non-spherical object either individually or in a combination of two or more forms. Furthermore, the mixer 204 or mixing elements 210, may have varying dimensions of depth, width and length, and FIG. 3 depicts the mixing elements 210 as elliptical shape for illustration only.

In an embodiment, mixer 204 is constructed with support rods to maximize rigidity. The mixing elements 210 can be welded or otherwise secured in place to the housing of the mixer 204 or not secured in place as desired. Non-limiting example of mixers 204 are standard pipe such as from 25 mm to 760 nm diameter with from 2 to about 36 mixing elements 210. The spacing between the mixing elements 210 may be selected to achieve a desired to level of mixing. There is no limit to how large the mixer 204 or mixing element 210 can be. The mixer may be fabricated with various construction materials such as but not limited to stainless steel and carbon steel, either individually or combinations of two or more thereof. Other construction materials are also available. The mixer may be plain, threaded or flanged ends or with special end connections. Mixer 204 can also be furnished with a heating or cooling jacket.

Embodiments of the invention include varying the diameter of the mixer 204 and number of mixing elements 210 in the mixer to achieve a sufficient degree of mixing as desired. For example, the diameter of the mixer may be the same size as the process pipeline. Where available pressure drop is limited, mixer with a larger diameter may be selected. The number of mixing elements 210 required and/or the pressure drop for a given application may be selected to achieve a desired to level of mixing.

In an embodiment, static mixer 204 includes a Low Pressure Drop (LPD) Static in-line mixer without moving parts. The static mixer 204 with one or more mixing elements 210 may be incorporated in existing or new pipelines. With no moving parts to wear out, non-limiting advantages may include minimum maintenance and longer life and good mixing results of liquids or gases with very low pressure drop. In an embodiment, viscosity is not a limitation.

Figure 4:
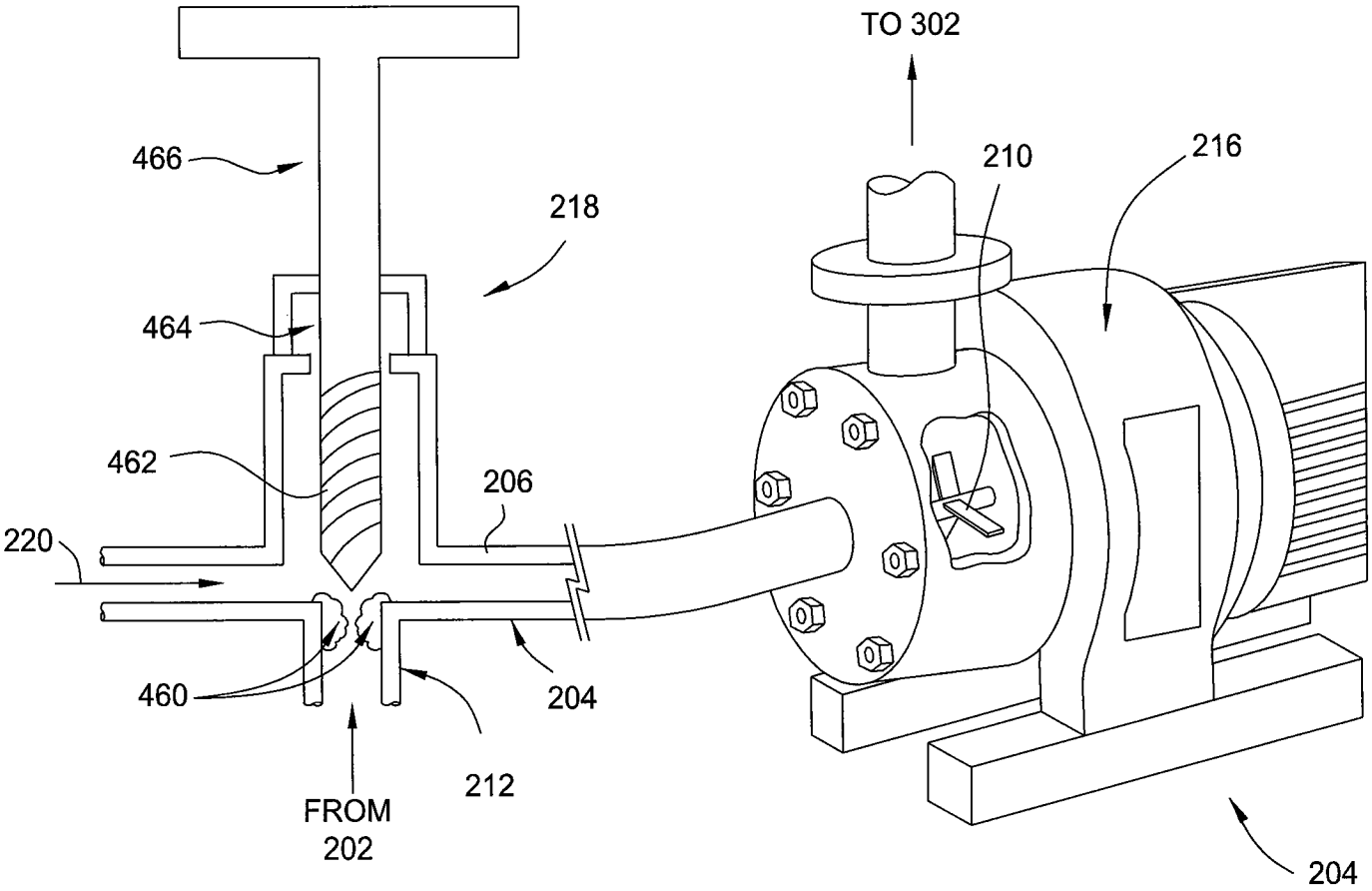
FIG. 4 is a schematic diagram of another embodiment of the material delivery system with a motor mixer.

FIG. 4 is another schematic diagram of mixing elements 210 of a dynamic mixer 204. The mixer 204 may have a motor 216 coupled to a shaft which turns the mixing elements 210 within the conduit 206. The mixer 204 may be a tube of sufficient length or have other features to add turbulence such that the catalyst or material has sufficient residence time and mixing to become activated.

The mixer 204 may optionally include one or more decloggers 218, as shown in FIG. 2 and FIG. 4. The declogger 218 is configured to remove built-up material 460, such as wetted catalyst, which may adhere to interior surfaces around the material inlet 212. In an embodiment, the declogger 218 is in front of or upstream of material inlet 212, and the mixing elements 210 mix the catalyst introduced into the conduit from the material inlet 212. Thus, the mixing elements 210 are downstream of the declogger 218. Referring primarily to FIG. 4, the declogger 218 includes one or more plungers 462 that extend through a seal gland 464 to one or more actuators 466. The seal gland 464 prevents leakage from the declogger 218 while allowing movement of the plunger 462. The plunger 462 is positioned to move between positions clear of and engaged with the material inlet 212. In the engaged position, the plunger enters the material inlet 212 through the conduit 206 to remove the built-up material 460 from the material inlet 212. The end of the plunger 462 may include threads or other projecting and/or recessed surface features which enhance the material removal efficiency of the plunger. The actuator 466 may be a handle to facilitate manual actuation of the plunger 462 as needed. In one embodiment, the actuator 466 may be used to impart an axial motion of the plunger, and optionally, the actuator 466 may impart a rotary motion to the plunger. It is contemplated that the actuator 466 may alternatively be an electrically, pneumatically or hydraulically powered actuator.

Activating Agent

Not to be bound by theory, material (such as catalyst) delivered to a unit such as biofuel unit may be wetted, i.e., activated with one or more activating agents 220 because reactants may be in liquid phase and gas may interfere with the delivered catalyst's interact with the reactants. In contrast, catalyst added to an FCC unit is usually not wetted because reactants are in gas phase, not liquid phase, and hence gas would not typically interfere with the added material or catalyst's interaction with reactants.

Also not to be bound by theory, many reactions are performed in solution. A solvent such as activating agent 220 may serve one or more functions during a reaction or in a reactor such as but not limited to below. The activating agent 220 may solvate the reactants to facilitate collisions thereby mixing between the reactant(s) or catalyst. The solvent, i.e. activating agent, may also provide a means of temperature control, either to increase the energy of the colliding particles so that they will react more quickly, or to absorb heat that is generated during an exothermic reaction. Also not to be bound by theory, embodiments of the invention includes activating a material, i.e., catalyst, with one or more activating agents 220, either individually or in combinations of two or more, based on one or more criteria such as but not limited to below as known to one of ordinary skill in the art. Like chemicals activates or dissolves like chemicals; hence, in an embodiment, non-polar activating agent activates non-polar catalyst as polar activating agent activates polar catalyst. Activating agent and or catalyst should be inert to the reaction conditions. Activating agent (and catalyst) should dissolve the reactants. Activating agent should have an appropriate boiling point. In an embodiment, the activating agent may be removed at the end of the reaction.

Hydrophilic Activating Agent Activating Hydrophilic Catalyst

In one embodiment, hydrophilic catalyst or material is activated with one or more activating agents 220 i.e. wetting agents that are hydrophilic, either individually or in a combination of two or more thereof. Non limiting examples of hydrophilic activating agent include alcohol and other polar solvents such as formic acid, acetic acid, water, acetone, and other polar protic solvents or polar aprotic either individually or in combination of two or more thereof. Non limiting examples of alcohol suitable as activating agent include n-butanol, isopropanol, n-propanol, ethanol, methanol, either individually or in a combination of two or more thereof. It should be appreciated that embodiments of the method and system include activating catalyst or a material with activating agent with a degree of polar to suit or match the catalyst being activated and "sufficient mixing of catalyst with activating agent" as desired. Measures or degree of polarity include but are not limited to one or more characteristics, either individually or in combination thereof, such as dipole moment, dielectric constant and miscibility with water as known to one of ordinary skill in the art. In an embodiment, molecules with large dipole moments and high dielectric constants are considered polar. Molecules with low dipole moments and small dielectric constants are considered non-polar. On an operational basis, solvents that are miscible with water are polar, while those that are not are non-polar.

Non limiting examples of polar protic activating agents include wherein protic refers to a hydrogen atom attached to an electronegative atom. In another embodiment, electronegative atom is oxygen and polar protic solvents are compounds of the general formula ROH. Examples of polar protic activating agents include but are not limited to water (HOH), methanol ($CH_3OH$), and acetic acid ($CH_3CO_2H$), either individually or combination of two or more thereof.

Non limiting examples of polar aprotic activating agents include wherein aprotic describes a molecule that does not contain an O—H bond. In one embodiment, polar aprotic activating agents include a bond that has a large bond dipole. Non limiting examples of polar aprotic activating agents include multiple bond between carbon and either oxygen or nitrogen such as acetone [$(CH_3)_2C{=}O$] and ethyl acetate ($CH_3CO_2CH_2CH_3$). It should be noted that hydrophilic activating agent may include some level of non-polar activating ingredient. In an embodiment, the hydrophlic activating agent is substantially polar.

Hydrophobic Activating Agent Activating Hydrophobic Catalyst

In one embodiment, hydrophobic catalyst is activated with one or more activating agents 220, i.e., wetting agents that are hydrophobic, either individually or in a combination of two or more thereof. Non limiting examples of hydrophobic activating agent include non-polar compounds that have low dielectric constants and are not miscible with water such as but not limited to hexane, benzene ($C_6H_6$), toluene, diethyl ether, chloroform, ethyl acetate, pentane, cyclo pentane, carbon tetrachloride ($CCl_4$), and diethyl ether ($CH_3CH_2OCH_2CH_3$), either individually or a combination of two or more thereof. It should be noted that hydrophobic activating agent may include some level of polar activating ingredient. In one embodiment, the hydrophobic activating agent is substantially non-polar.

In one embodiment, the activating agent may have range of polarity to suit or match the catalyst being activated. Approximating language, as used herein throughout the specification and claims, may be applied to modify any quantitative or qualitative representation that could permissibly vary without resulting in a change in the basic function to which it is related. Accordingly, a value modified by a term such as "from about", "to about", "substantially hydrophilic" or "substantially hydrophobic" or "sufficiently mixing catalyst with activating agent" not to be limited to a specified precise value, and may include values that differ from the specified value. In at least some instances, the approximating language may correspond to the precision of an instrument for measuring the value. Furthermore, "substantially hydrophilic" or "substantially hydrophobic" "sufficiently mixing catalyst with activating agent" may be used in combination with quantitative or qualitative value, and include a varying amount of "hydrophilic" and or "hydrophobic" activating agent 220 and varying amount of mixing of catalyst with activating agent 220 and is not to be limited to a specified precise quantitative value, and may include values that differ from a specified value.

It should be appreciated that an embodiment of the method and system may further include presence of activating agents 220 which are polar and non-polar to suit or match the catalyst being activated and "sufficiently mixing catalyst with activating agent" as desired. An embodiment of the method and system includes sufficiently mixing a material with a plurality of activating agents 220, as desired. The plurality of activating agents 220 may be the same or differ from each other.

Delivery Vessels

Plurality of Separate Material Storage Containers Coupled to the Vessel

Figure 5:
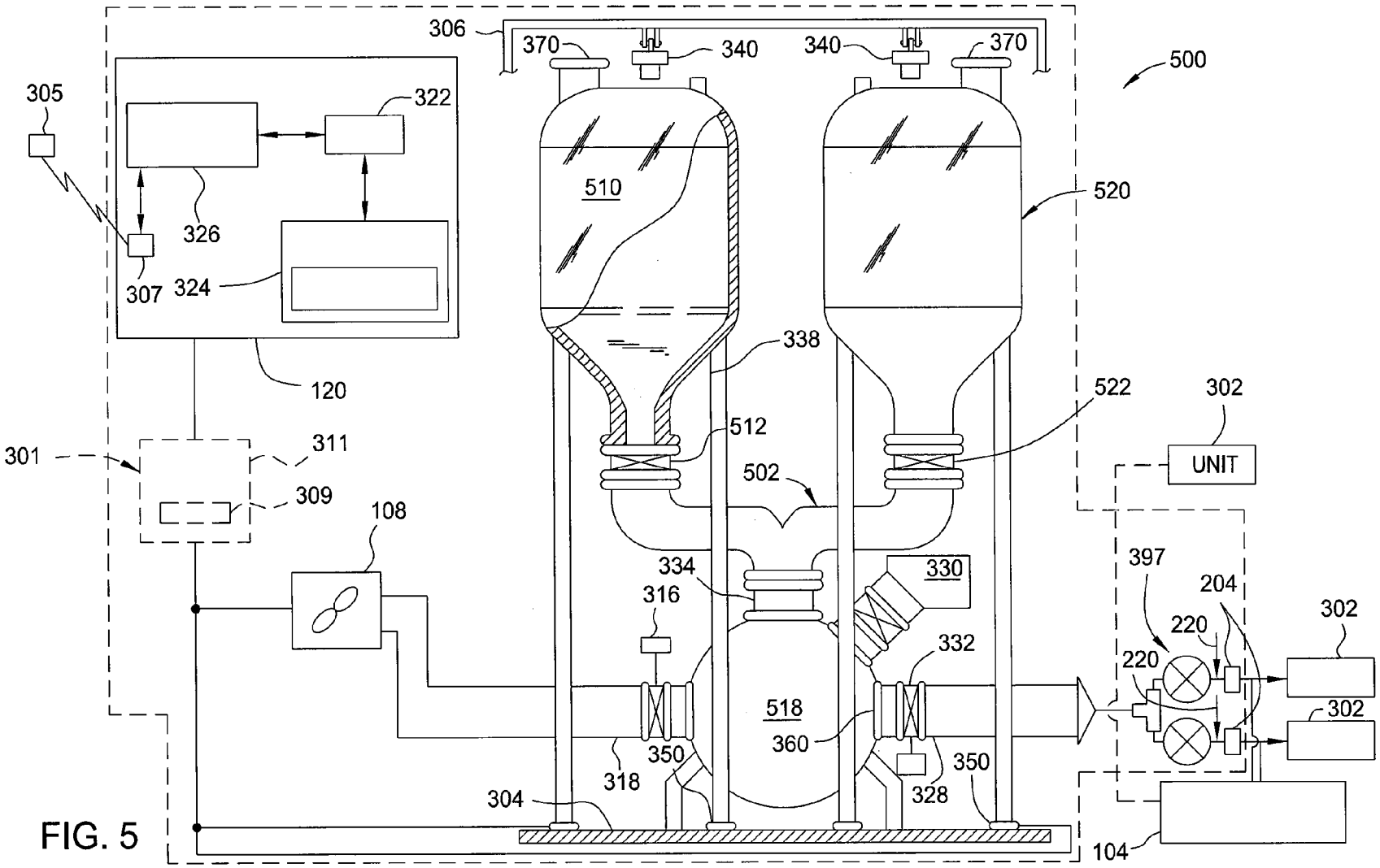
FIG. 5 is a schematic view of a unit coupled to a material delivery system with a plurality of separate material storage containers in accordance with an embodiment of the invention.

Embodiments of material delivery system 500 with one or more mixers 204 coupled to the delivery vessel 518 and configured to sufficiently mix the material with an activating agent include material delivery system 500 coupled to one or more units 302 to introduce multiple materials from a plurality of separate material storage containers are shown in FIG. 5. The material delivery system 500 includes a delivery vessel 518 coupled to a plurality of separate material storage containers (i.e. storage vessels or low pressure vessels), illustratively shown in one embodiment as a first low pressure material storage container 510 and a second low pressure storage container 520. Any number of low pressure material storage containers may be coupled to a single delivery vessel 518, based on need and desire of the number of materials or time limit of material delivery, etc. Each of these material storage containers 510, 520 may be controlled by either common or independent control modules 120.

The separate material storage containers 510, 520 may be configured to dispense the same or different materials to the unit(s) 302 and operate substantially similar to material storage container 320, described below with reference to FIG. 9A. In one embodiment, the storage vessels, i.e., low pressure material storage container 510, 520, are coupled to a manifold 502 which directs the plurality of materials to a common material delivery line 334 for delivery into the delivery vessel 518. Alternately, each material storage container 510, 520 can be independently coupled to the delivery vessel 518 via a respective inlets formed in the delivery vessel 518. Each material storage container 510, 520 is coupled to an independent metering device 512, 522 which controls the amount of material dispensed from each material storage container 510, 520 to the delivery vessel 518 for injection into the unit 302. In one embodiment, the metering device 512, 522 is configured similar to the metering device 308 described above. Furthermore, in one embodiment, a sensor, such as least one load cell 350 is configured to provide a metric indicative of an amount of material dispensed from each separate material storage container 510, 520.

In this configuration, the material delivery system is capable of sequentially providing material from a predefined one of the material storage container storage container 510, 520, or alternatively, blending measured amounts from each material storage container storage container 510, 520 in the delivery vessel 518 for injecting into one or more units 302 in a single shot pot delivery or series of injections. The material delivery system 500 may further include one or more sensors to determine if the delivery vessel is respectively coupled to the inlet of a material storage container from the plurality of separate material storage containers.

At Least Two Compartments within Vessels

Figure 6:
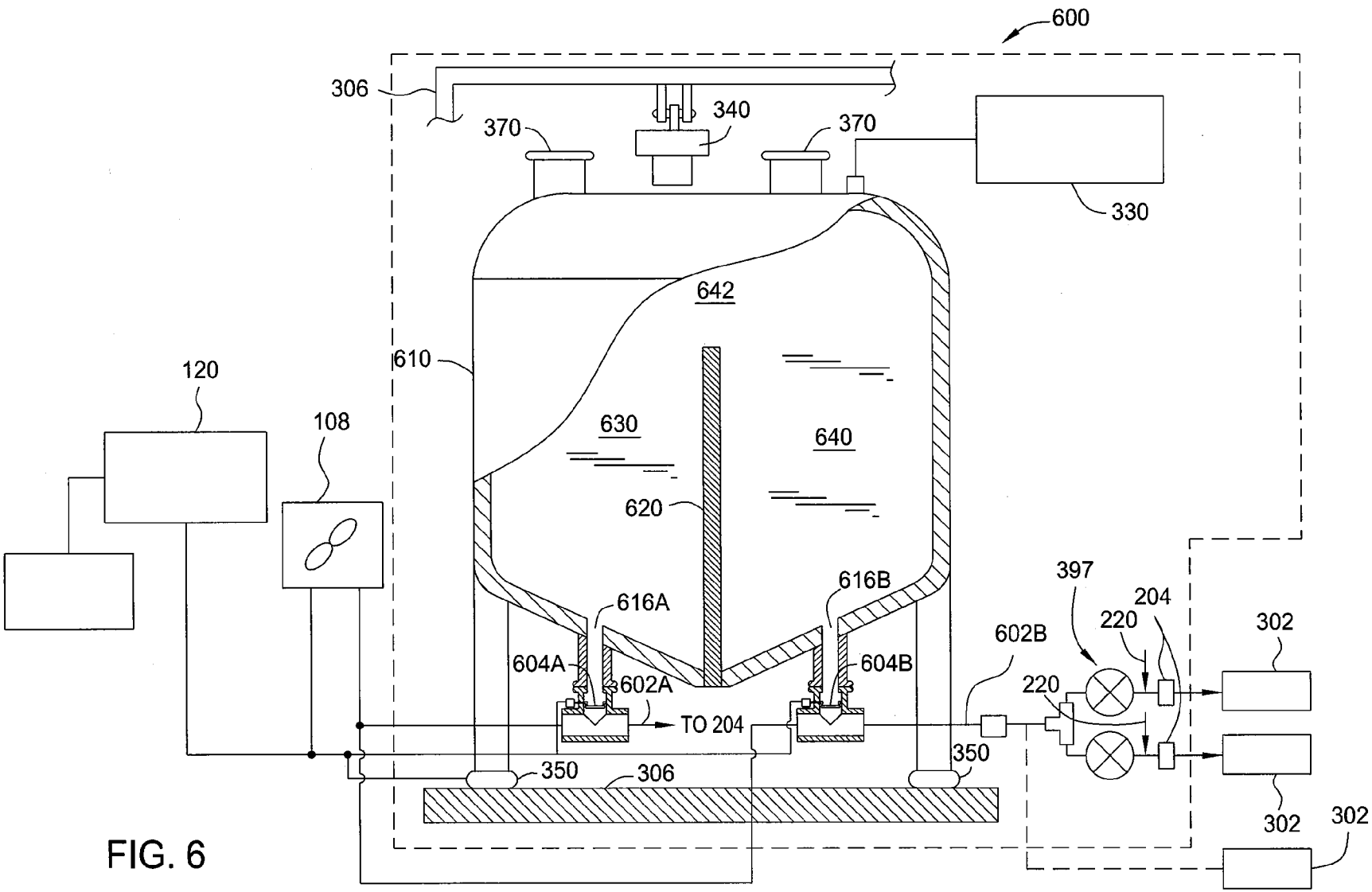
FIG. 6 is a schematic view of a unit coupled to a material delivery system with the delivery vessel having at least two compartments in accordance with an embodiment of the invention.

FIG. 6 depicts another embodiment of a material delivery system 600 with one or more mixers 204 coupled to the delivery vessel 610 and configured to sufficiently mix the material with an activating agent. The material delivery system 600 may be configured to be coupled to one or more units 302, such as an FCC or biofuel unit as described herein, among other configurations. The material delivery system 600 is adapted to provide multiple materials to the unit(s) 302, either in a mixed state or individually. The material delivery system includes a delivery vessel 610 interfaced with a sensor, such as one or more load cells 350, suitable for providing a metric suitable for resolving a change in weight of the delivery vessel 610.

The delivery vessel 610 also includes a separator 620 disposed in the delivery vessel and defining at least two compartments 630, 640 within the vessel. A plenum 642 may be defined in the delivery vessel common to each compartments, or each compartment may have its own separate plenum above the material disposed therein. Each compartment 630, 640 has a respective outlet 616A, 616B. It is contemplated that the delivery vessel may be divided into any number of compartments and each compartment may independently be of varying shape.

The compartments 630, 640 may be configured to dispense the same or different materials to one or more units 302 and operate substantially similar to material delivery systems described above. In one embodiment, the outlets 616A, 616B of the delivery vessel are coupled by delivery lines 602A, 602B to a manifold, the outlet of which directs the plurality of materials to a single unit 302. Alternately, each outlet 616A, 616B of the delivery vessel can be independently coupled via respective delivery lines 602A, 602B to two or more separate units 302. Each compartment may be coupled to an independent metering device 604A, 604B which controls the amount of material dispensed from each compartment of the delivery vessel 610 for injection into the unit 302. In one embodiment, the metering devices 604A, 604B are configured similar to the metering devices described above.

In an embodiment, the material delivery system 600 is capable of sequentially providing material from a defined compartment of the delivery vessels to one or more units. The material delivery system may further include one or more sensors to determine if the unit is respectively coupled to the correct compartment from the plurality of compartments of the vessel.

In a particular embodiment, the material delivery system includes a control module 120 for controlling the rates and/or amounts of material provided to one or more units 302 by the material delivery system 500.

Mobile Material Delivery System

Figure 7:
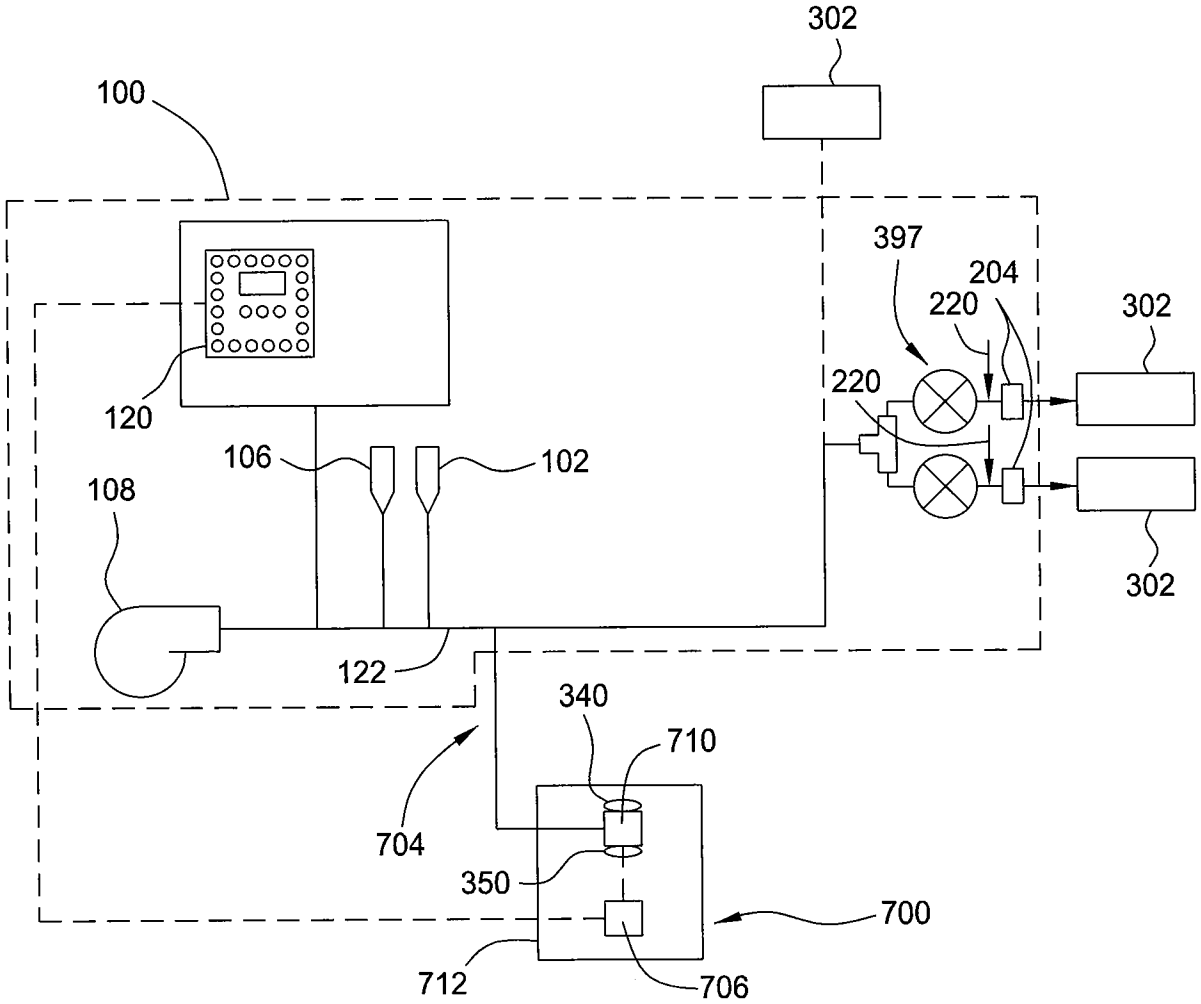
FIG. 7 is a schematic view of a unit coupled to a mobile material delivery system in accordance with an embodiment of the invention.

FIG. 7 is a simplified schematic of an embodiment of a material delivery system 700 with one or more mixers 204 coupled to a delivery vessel 710 configured to sufficiently mix the material with an activating agent wherein the material delivery system 700 is mobile. In an embodiment, the mobile material delivery system 700 may be configured to be coupled to one or more units 302 as described herein, among other configurations. The mobile material delivery system 700 is configured to be easily transportable over great distances thereby enabling the mobile material delivery system 700 to be shipped and coupled to one or more existing units 302, such as but not limited to a FCC or biofuel unit on short notice. Additionally, the modular aspects of the mobile material delivery system 700 also enables the material delivery system 700 to be decoupled from one unit 302, transported, and coupled to another unit 302 with minimal effort. Thus, the mobile material delivery system 700 enables a processor to configure a working processing unit with material delivery systems with minimal lead time, thereby providing the process control flexibility required to quickly take advantage of market opportunities and address unplanned events requiring process change, such as limiting emissions through catalyst reactions. In another embodiment, the modular aspects of the mobile material delivery system 700 enables the material delivery system 700 to be decoupled from one acrylonitrile process unit, transported, and coupled to another acrylonitrile process unit with minimal effort.

The mobile material delivery system 700 includes a material delivery vessel 710 mounted to a transportable platform 712. The delivery vessel 710 may be configured similar to the other vessels described herein. The delivery vessel 710 is interface with sensors, such as one or more load cells 350, that are configured to provide a metric suitable for determining an amount of material dispensed from the delivery vessel 710 from a change in weight of the delivery vessel 710. In an embodiment, the delivery vessel 710 (and/or load cells 350) is interfaced with a calibration device 340 as described further below.

The material delivery vessel 710 may be one or more vessel, or vessel and container combinations as described herein, among other suitable configurations. The delivery vessel 710 is coupled by a conduit 704 to the process line 122 to dispense material to the unit 302. The conduit 704 may be a flexible process pipe, a temporary process pipe, or a hard pipe.

The transportable platform 712 is generally configured to support the material delivery vessel 710 and associated components. The transportable platform 712 may be mounted to a foundation of a unit 302, or be disposed adjacent thereto. The transportable platform 712 is configured to facilitate shipment of the mobile material delivery system 700 by conventional means, e.g., road, air, sea or rail. For example, in an embodiment, the mobile material delivery system 700 has a transportable platform 712 in the form of a container, which allows for rapid delivery of the mobile material delivery system 700 by conventional means, for example, by truck, ship, plane, train, helicopter, barge and the like. It is also contemplated the transfer platform 712 may be integrally part of a trailer, barge, ship, plane, truck, rail car and the like. The ease of transporting the platform 712 advantageously allows the mobile material delivery system 700 to be coupled and begin injecting material to a unit 302 within a matter of hours or even as little as less than one hour, compared with the several days required to install a conventional permanent or semi-permanent injection system, which is substantially less than the time required to ship, assembly and install a conventional injection system.

An embodiment of the mobile material delivery system 700 includes a vessel 710 that may be feed by a plurality of material storage containers, as described with reference to FIGS. 5 and 8A-D. In another embodiment, the delivery vessel 710 may have a plurality of internal compartments, as described with reference to FIG. 6 which may provide mixtures of different material as needed or per a predefined process sequence. Another embodiment of the mobile material delivery system 700 also provides mixtures of different material as needed or per a predefined process sequence.

Figure 8A:
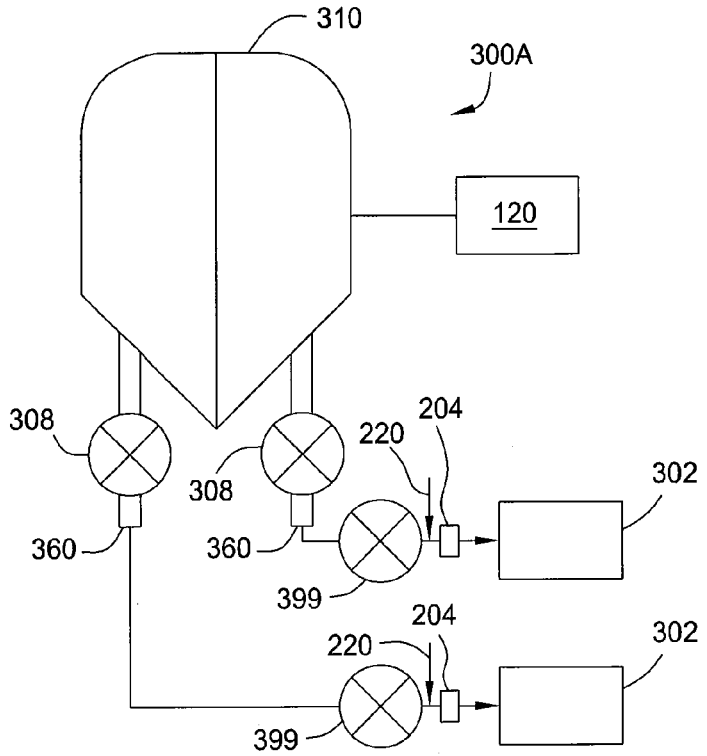
FIG. 8A is a schematic view of a material delivery system with a plurality of dispense mechanisms outlets coupled separately to a plurality of units, in accordance with an embodiment of the invention.

With reference to FIG. 8A, there is shown one embodiment of a material delivery system 300A with one or more mixers 204 coupled to a delivery vessel 310 and configured to sufficiently mix the material with an activating agent 220. The material delivery system 300A includes one or more delivery vessels 310 and one or more dispense mechanisms 360. The outlet of the dispense mechanism 360 is also the outlet of the metering device 308. The dispense mechanism 360 includes sensors 282, such as load cells, (not shown in FIG. 8A-D), which are utilized as illustrated and described with reference to FIG. 2 for resolving the amount of material metered by the metering device 308.

The one or more dispense mechanisms 360 are configured to couple the delivery vessel 310 to one or more units 302 and the one or more dispense mechanisms 360 are configured to dispense material to the one or more units 302.

In one embodiment, the delivery vessel is configured to dispense material to a plurality of units. In one embodiment, the delivery vessel includes a plurality of dispense mechanisms 360 adapted for coupling to the plurality of units 302. In one embodiment, a respective dispense mechanism 360 is coupled to the one or more respective units 302. In another embodiment, a dispense mechanism 360 is adapted for coupling to the plurality of units sequentially, wherein the outlet is alternatively sequentially configured to be coupled to a plurality of units In one embodiment, sensors, such as one or more load cells 350 (as shown in at least in the embodiment depicted in FIG. 9A) are configured to provide a metric indicative of known force imparted on the load cell 350 or delivery vessel 310 so that the amount of catalyst dispensed may be determined. Although not shown in the embodiments of FIGS. 8A-D, sensors 282 as discussed with reference to FIG. 2 are utilized for this purpose.

Figure 8B:
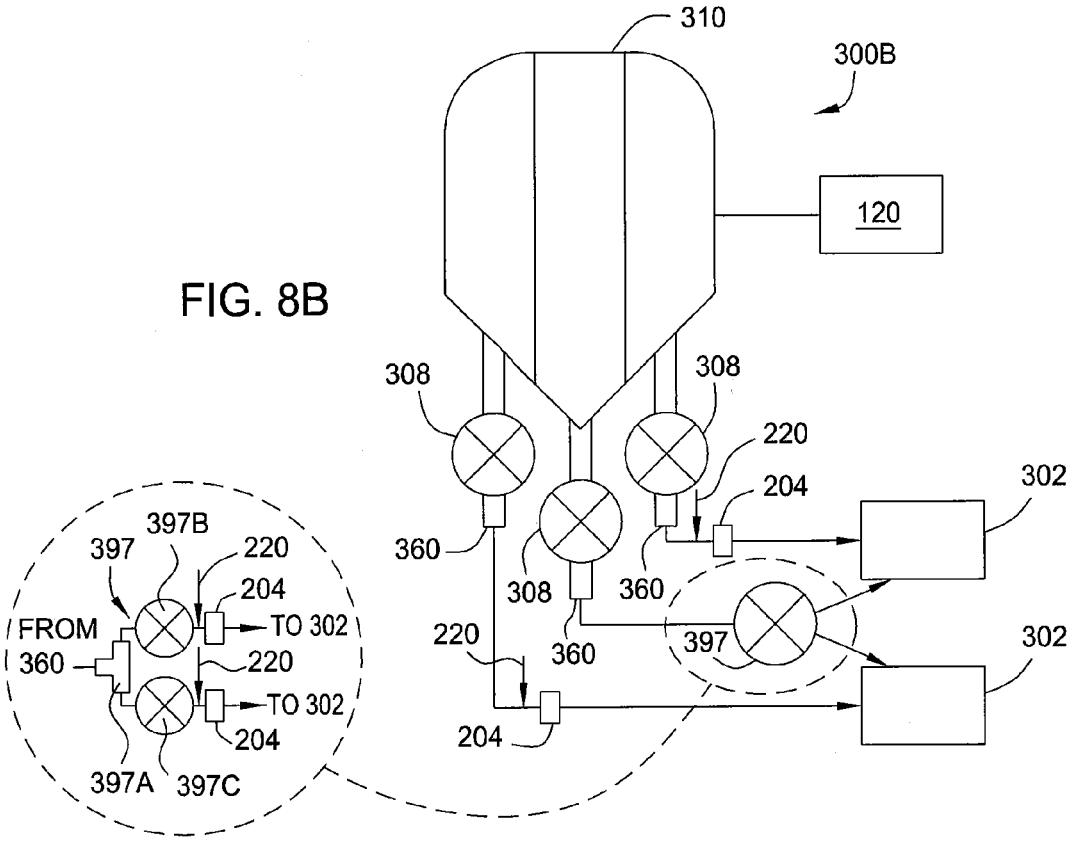
FIG. 8B is a schematic view of a material delivery system with a plurality of dispense mechanisms outlets coupled to a plurality of units, wherein at least one of the dispense mechanisms outlets is selectively coupled to at least two of the plurality of units, in accordance with an embodiment of the invention.
Figure 8C:
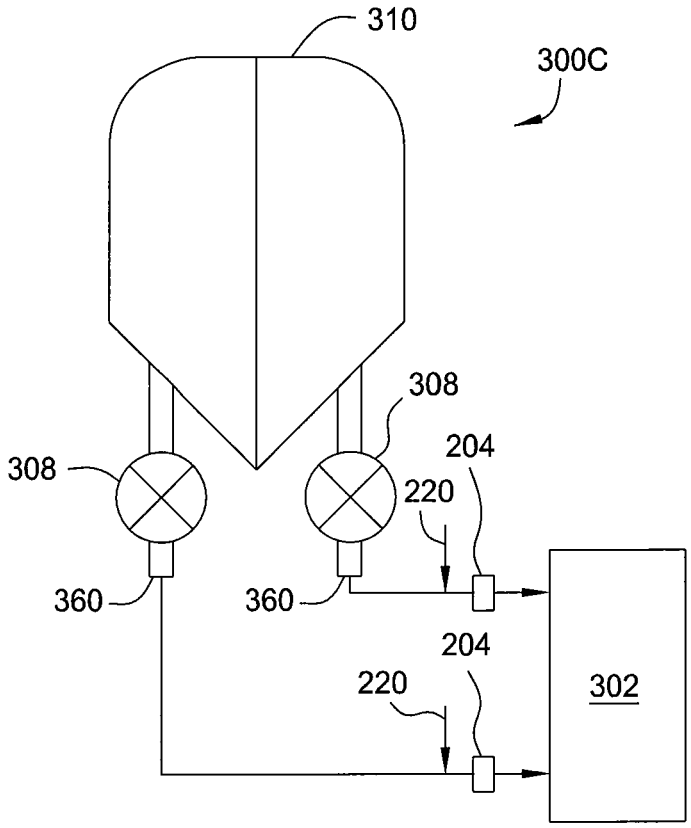
FIG. 8C is a schematic view of a material delivery system with a plurality of dispense mechanisms outlets coupled separately to a single unit in accordance with an embodiment of the invention.
Figure 8D:
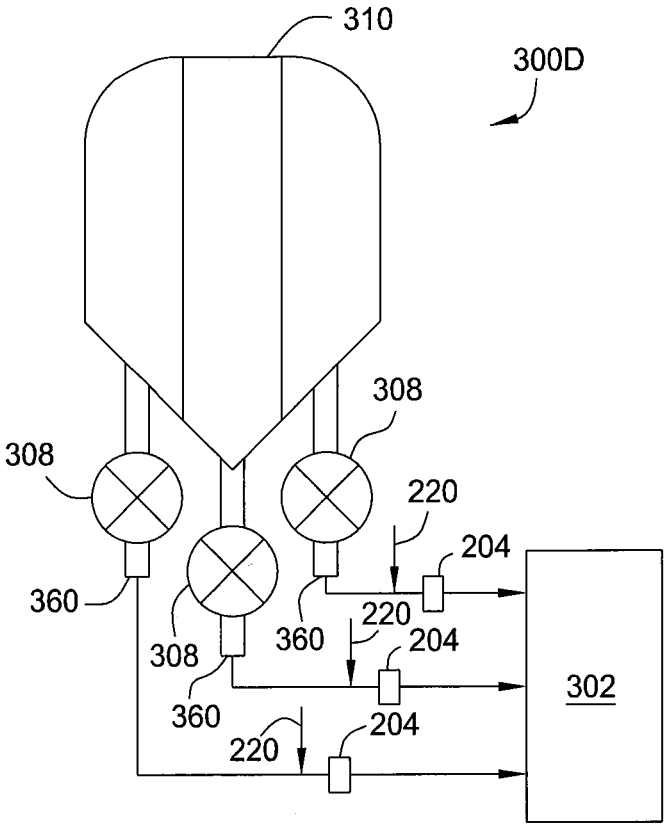
FIG. 8D is another schematic view of a material delivery system with a plurality of dispense mechanisms outlets coupled to a single unit, in accordance with an embodiment of the invention

In one non-limiting embodiment, as shown in FIG. 8A, a plurality of dispense mechanisms 360 are respectively coupled to a plurality of units 302 separately. In another non-limiting embodiment, as shown in FIG. 8B, the plurality of dispense mechanisms 360 of a delivery system 300B with one or more mixers 204 configured to sufficiently mix the material with an activating agent are respectively coupled to a plurality of units 302 separately, wherein at least one of the dispense mechanism 360 may be coupled to a selected one of the units 302 by a selector or diverter valve 397. The diverter valve 397 is also shown in other embodiments for selecting which unit will require activated material. The selector valve may also be several shut off valves coupled by a Tee. The Tee is coupled to the outlet of the one or more dispense mechanisms. The outlets of the shut off valves are coupled to the plurality of units. In such an embodiment as FIG. 8B, one or more dispense mechanisms 360 which couple to the multiple units 302 are connected at least partially at one or more points. In another embodiment of a delivery system 300C with one or more mixers 204 configured to sufficiently mix the material with an activating agent, as shown in FIG. 8C, a plurality of dispense mechanisms 360 are respectively coupled to a unit 302 separately. In another embodiment of a delivery system 300D with one or more mixers 204 configured to sufficiently mix the material with an activating agent, as shown in FIG. 8D, a plurality of dispense mechanisms 360 are respectively coupled to a unit 302.

Figure 9A:
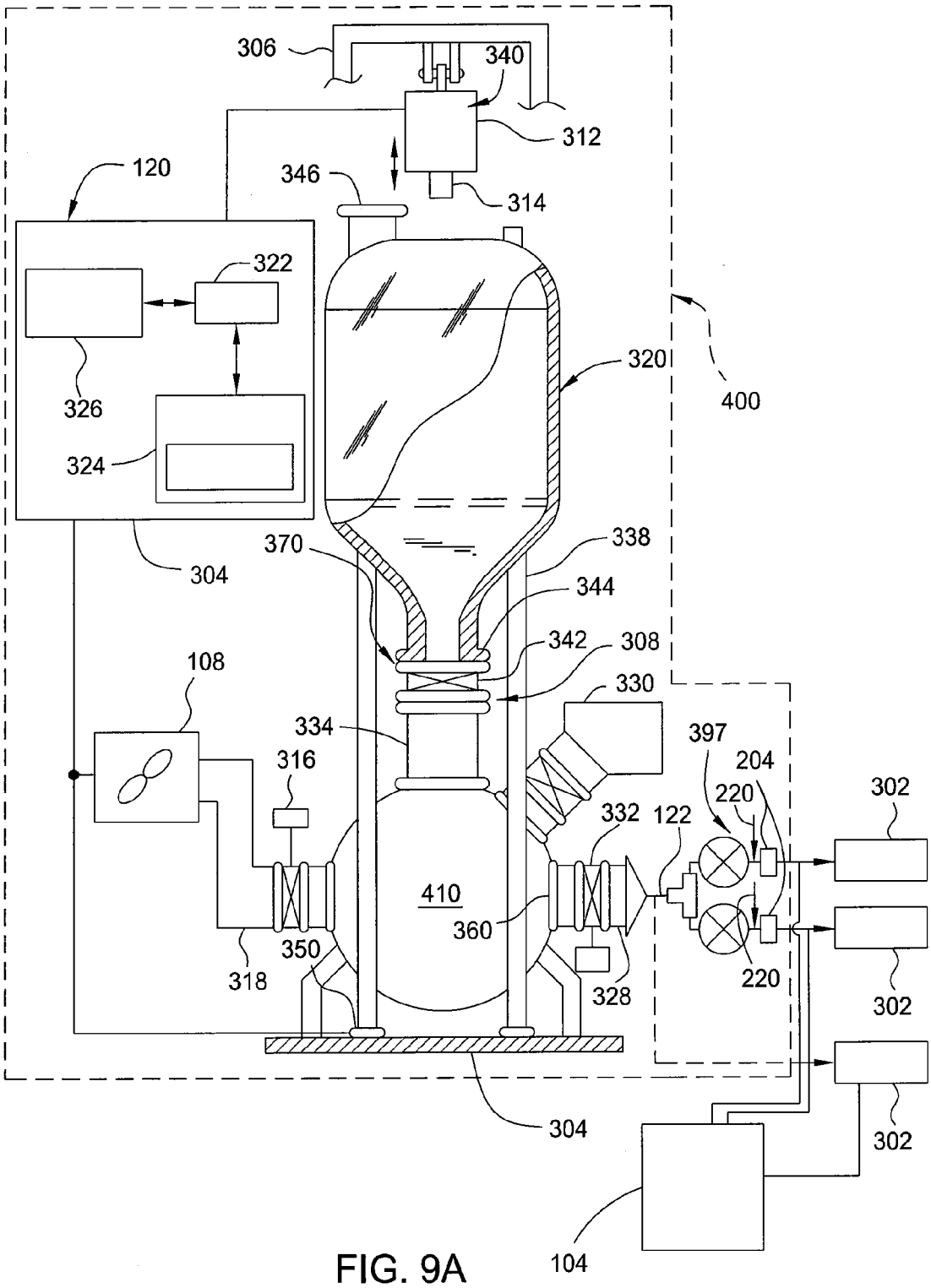
FIG. 9A is a schematic view of a material delivery system in accordance with an embodiment of the invention.

In a particular embodiment illustrated in FIG. 9A, a material delivery system 400 with one or more mixers 204 configured to sufficiently mix the material with an activating agent may be supported on a surface 304, such as a concrete pad, metal structure or other suitable support. Although not completely shown, a frame 306 is supported by the surface 304. The frame 306 may be fabricated from any rigid materials suitable such that deflection of the frame 306 does not introduce error into the measurement by the load cell 350.

In the embodiment depicted in FIG. 9A, a material delivery system 400 with one or more mixers 204 coupled to a delivery vessel and configured to sufficiently mix the material with an activating agent may also include a separate material storage container and a pressure control device 330. The material delivery system 400 may be configured to be coupled to one or more units 302, as described with reference to FIGS. 8A-D, among other configurations. One or more storage containers 320 are interfaced with the load cell 350 such that changes in the weight of a storage container 320 may be utilized to determine the amount of material i.e. catalyst, product, powder, additive, etc., dispensed to the one or more units 302 through the delivery vessel 310. The pressure control device 330 is coupled to the delivery vessel and configured to selectively pressurize the delivery vessel relative to the storage vessel to a pressure sufficiently high to provide material to the unit 302. It should be appreciated that the material delivery system can include one or more delivery vessels, one or more separate material storage containers, one or more pressure control devices, and one or more load cells and connected to one or more units 302.

Figure 9B:
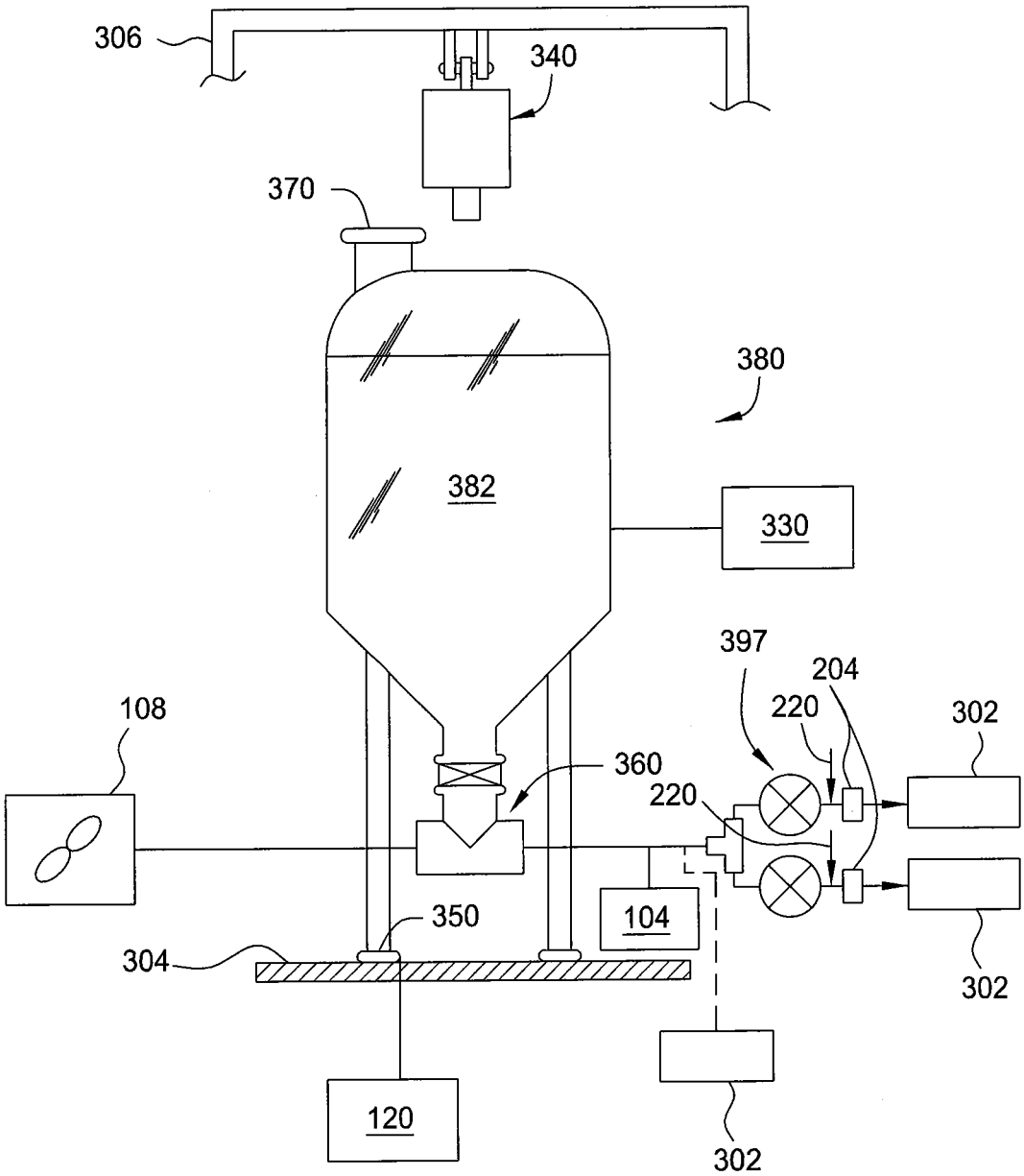
FIG. 9B is a schematic view of a material delivery system in accordance with an embodiment of the invention.

FIG. 9B depicts another embodiment of a material delivery system 380 with one or more mixers 204 coupled to a delivery vessel 382 and configured to sufficiently mix the material with an activating agent 220 for delivering material to one or more units 302. The material delivery system 380 may be configured to be coupled to one or more units 302 as described with reference to FIGS. 8A-D, among other configurations. The material delivery system 380 includes a pressure vessel 382 of a size suitable for storing enough material for a number of material additions performed over a selected interval, such as over a 24 hour period. The material delivery system 380 generally has a pressure control device 330, and at least one of load cell 350. The delivery vessel 382 is loaded while at atmospheric or sub-atmospheric pressure though an inlet port 370. Once the delivery vessel 382 is loaded, the inlet port 370 is closed and the delivery vessel 382 is pressurized by the pressure control device 330 to a level that facilitates delivery of the material to the unit 302. In one embodiment, catalyst is metered to a unit selectively through a metering device 308 of the delivery vessel 382. The load cells 350 are utilized to monitor the change in weight of the delivery vessel 382 such that the amount of material dispensed to the unit 302 through the metering device 308 can be resolved. One example of a material delivery system that may be adapted to benefit from the invention is described in U.S. Pat. No. 7,050,944, issued May 23, 2006, which is incorporated by reference in its entirety.

Figure 9C:
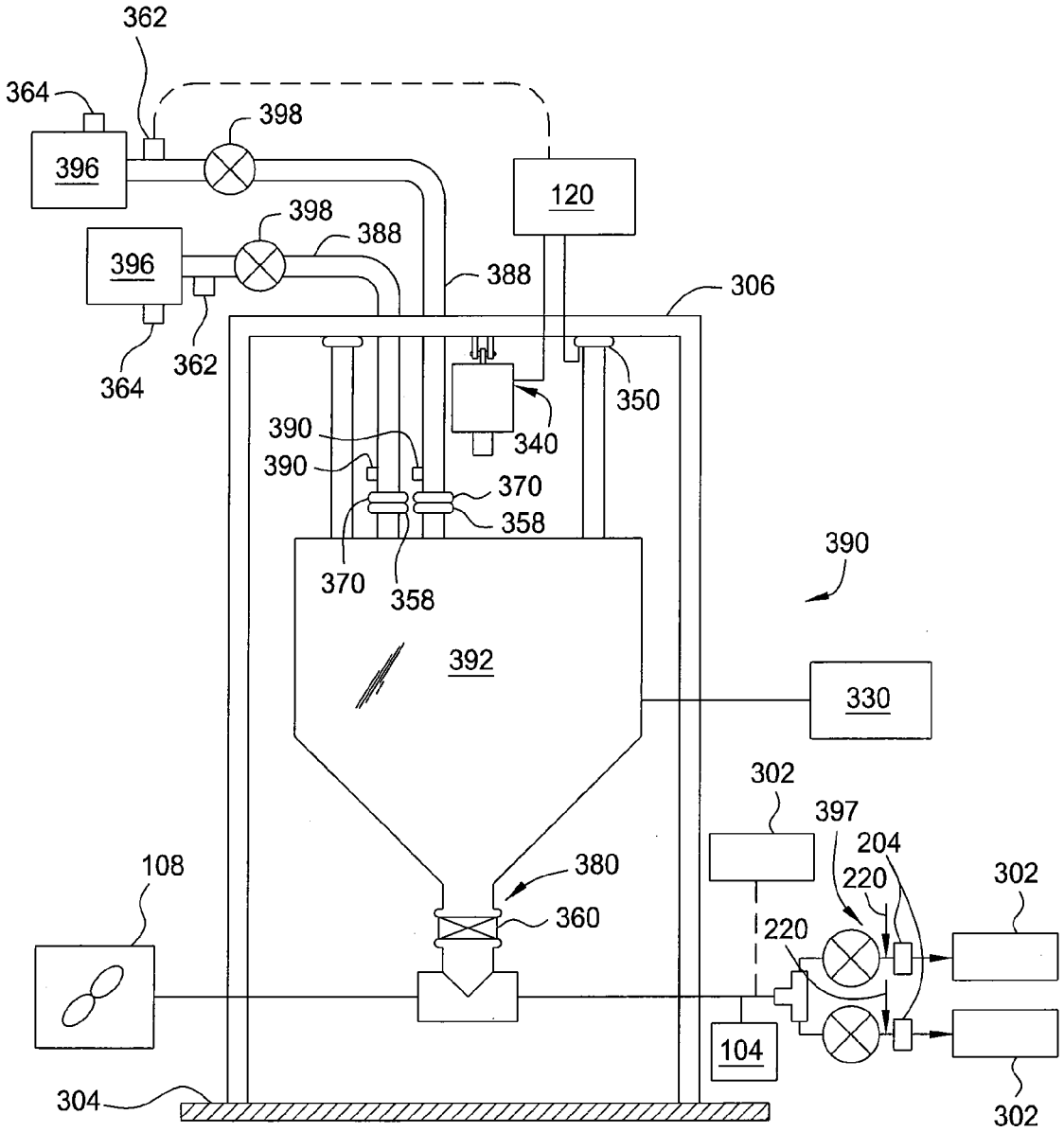
FIG. 9C is a schematic view of a material delivery system in accordance with an embodiment of the invention.

FIG. 9C depicts another embodiment of a material delivery system 390 with one or more mixers 204 coupled to delivery vessel and configured to sufficiently mix the material with an activating agent 220 connected to more than one unit 302. The material delivery system 390 may be configured to be coupled to one or more units 302 as described with reference to FIGS. 8A-D, among other configurations. The material delivery system 390 includes a pressure vessel shown suspended from a frame 306. Alternatively, the delivery vessel 392 may be supported from the surface 304. The size of the delivery vessel 392 may be selected to store enough material for a number of material additions performed over a selected interval, such as over a 24 hour period. Alternatively, the size of the delivery vessel 392 may be selected to store only enough material for a single addition of material to the system, or for a limited number of additions performed over a selected interval. The material delivery system 394 generally has a pressure control device 330, and a sensor, such as at least one of load cell 350. In one embodiment, the delivery vessel 392 is loaded while at atmospheric or sub-atmospheric pressure through an inlet port 370 from one or more storage containers 396. In one embodiment, the delivery vessel 392 is loaded at slightly positive pressure. In another embodiment, selection between storage containers 396 may be made using a manifold and/or control valves coupling the containers 396 to a common inlet port, or by selectively actuating a respective valve 398 disposed in series with a hose 388 individually coupling each container 396 to a respective inlet port 370. The inlet ports 370 may be fitted with self-sealing quick connects which prevent flow through the port 370 when the hose 388 is not connected. Alternatively, each port 370 may be fitted with a valve to control the flow therethrough. The containers 396 may be used to hold different or the same type of material. Although only two containers 396 are shown, it is contemplated that the material delivery system 390 may be configured to accept any number of containers 396. Once the delivery vessel 392 is loaded, the inlet port 370 is closed and the delivery vessel 392 is pressurized by the pressure control device 330 to a level that facilitates delivery of the material. Material is metered to the unit 302 selectively through a metering device 308 coupled to the delivery vessel 392. In one embodiment, the load cells 350 are configured to monitor the change in weight of the delivery vessel 392 such that the amount of material dispensed to the unit 302 through the metering device 308 can be resolved.

Figure 9D:
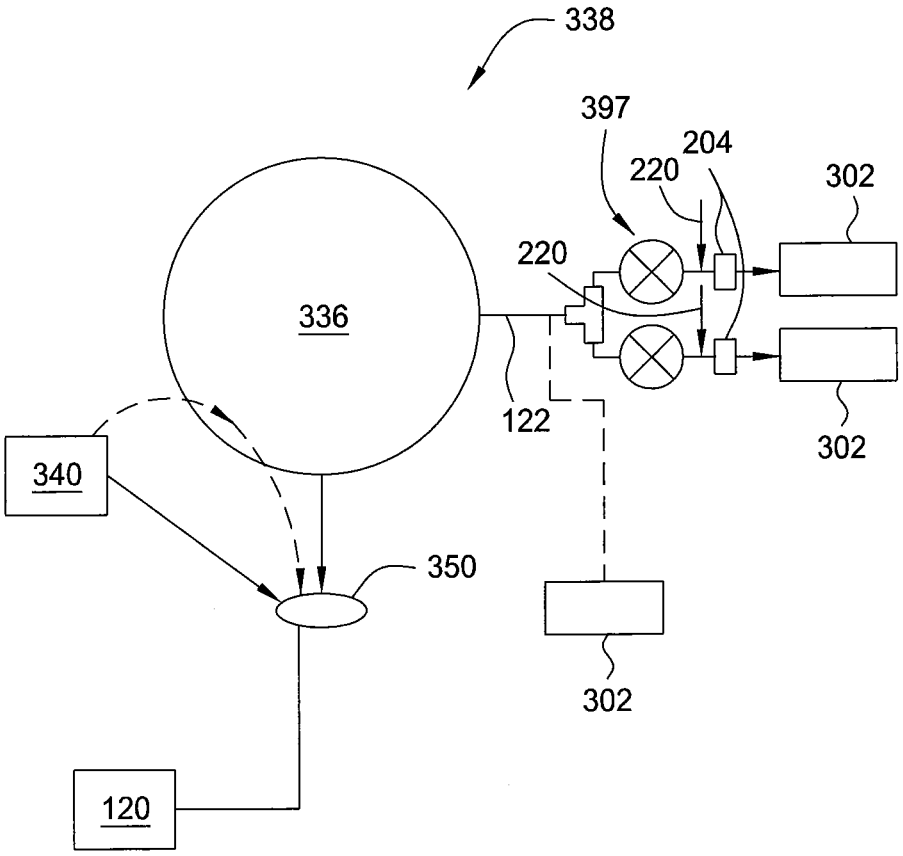
FIG. 9D is an upper level schematic diagram of a material delivery system in accordance with an embodiment of the invention.

FIG. 9D is a high level schematic diagram of another embodiment of a material delivery system 338 with one or more mixers 204 coupled to a delivery vessel and configured to sufficiently mix the material with an activating agent suitable for providing material to more than one unit 302, such as an FCC or biofuel unit. The material delivery system 338 may be configured to be coupled the unit 302 as described with reference to FIGS. 8A-D and 9A-C, among other configurations. The material delivery system 338 includes one or more material delivery vessels 336. At least one vessel 336 is interfaced with a sensor, such as one or more load cells 350. The one or more load cells 350 are coupled to the delivery vessel 336 in a manner that enables a control module 120 to resolve an amount of material passing through the system 338 to one or more units 302. In one embodiment, the one or more load cells 350 are utilized to determine a change in weight of at least one material delivery vessel 336 which is indicative of the amount of material provided by the material delivery system 338 to at one or more unit 302.

In a particular embodiment, the material delivery system further includes an automated load cell calibration device 340. The automated load cell calibration device 340 is adapted to impart a force of known value to the delivery vessel 336 or a load cell of the material delivery vessel 336. The automated load cell calibration device 340 is configured to generate a force upon the delivery vessel 336. The force may be a push or pull. The automated load cell calibration device 340 may be coupled to the delivery vessel 336, or only contact the delivery vessel 336 when actuated to generate the force. It is also contemplated that the automated load cell calibration device 340 may be coupled to the delivery vessel 336 and actuated to exert a force on the frame 306 or surface 304 (such as shown for example in FIG. 9C). The automated load cell calibration device 340 may be a pneumatic or hydraulic cylinder, a motorized power or lead screw, a cam, linear actuator or other suitable force generation device. The amount of force generated by the automated load cell calibration device 340 is generally selected to be in a range suitable for calibrating the load cells 350.

In the embodiment depicted in FIG. 9A, the automated load cell calibration device 340 is a pneumatic cylinder 312 having a rod 314 that may be actuated to contact and press against the container 320. By precisely controlling the pressure of the air provided to the cylinder 312, the rod 314 will exert a predetermined force against the container 320 which can be utilized to confirm the accuracy and/or calibrate the load cell 350. Systems and methods of using calibration device are disclosed in U.S. application Ser. No. 11/923,136, which is incorporated by reference in its entirety.

Computer Control Unit

In one embodiment, the material delivery system with one or more mixers 204 configured to sufficiently mix the material with an activating agent is coupled to one or more units, and is configured to dispense one or more activated materials into the units to control processing attributes such as the ratio of products recovered in a distiller of the unit and/or to control the emissions from the unit. The material delivery system includes a control module 120 to control the rates and or amounts of material that the material delivery system provides to the units 302 through the mixer 204.

Referring to FIG. 9A, the control module 120 has a central processing unit (CPU) 322, memory 324, and support circuits 326. The CPU 322 may be one of any form of computer processor that can be used in an industrial setting for controlling various chambers and subprocessors. The memory 324 is coupled to the CPU 322. The memory 324, or computer-readable medium, may be one or more of readily available memory such as random access memory (RAM), read only memory (ROM), floppy disk, hard disk, or any other form of digital storage, local or remote. The support circuits 326 are coupled to the CPU 322 for supporting the processor in a conventional manner. These circuits include cache, power supplies, clock circuits, input/output circuitry, subsystems, and the like. In one embodiment, the control module 120 is a programmable logic controller (PLC), such as those available from GE Fanuc. However, from the disclosure herein, those skilled in the art will realize that other control modules such as microcontrollers, microprocessors, programmable gate arrays, and application specific integrated circuits (ASICs) may be used to perform the controlling functions of the control module 120. Control module 120 that may be adapted to benefit from the invention is described in the U.S. Pat. No. 7,050,944 issued May 23, 2006; U.S. Pat. No. 6,859,759 issued Feb. 22, 2005; U.S. Pat. No. 7,369,959 issued May 6, 2008; U.S. patent application Ser. No. 10/859,032 filed Jun. 2, 2004; and U.S. patent application Ser. No. 11/136,024 filed May 24, 2005, all of which are incorporated by reference in their entireties.

FIG. 5 depicts the optional use of a hazardous location control substation 301 disposed between the control module 120 and one or more of sensors 282, such as the load cells 350. The hazardous location control substation 301 includes a specific purpose processor 309 disposed within an explosion-proof enclosure 311. The specific purpose processor 309 receives signals from one or more of the load cells 350 and converts those signals into a form readable by the control module 120 such that material dispensed from the material delivery system 500 may be resolved. Use of the hazardous location control substation 301 in the hazardous environment proximate the unit 302 allows the control module 120 to be located in a safe environment remote from the substation 301. Since the location of the control module 120 is in a safe environment, the components of the control module 120 do not have to be contained in an explosion-proof enclosure. This allows the control module 120 to be vented to provide more efficient cooling of control module electronics, thereby extending the life and reliability of the control module 120 and operation of the material delivery system 500. In one embodiment, the control module may be disposed in a safe block house remote from the unit 302.

The control module 120 includes an antenna 307 or other communication device which allows the control module 120 to communicate with a remote device 305. The communication between the control module 120 and the remote device 305 may be wireless over wire or a combination thereof. Since the requirement to have the antenna 307 inside an explosion-proof enclosure is not required when the hazardous location control substation 301 is used, communication between the control module 120 and remove device 305 may be improved. The communication between the control module 120 and the remote device 105 may be in response to a pre-defined event or a periodic schedule. Alternatively, the communication between the remote device 305 and the control module 120 may be continuous, such that real time information may be communicated. Examples of remote devices, methods of communication there between, along with examples of the subject matter communicated, are described in more detail below.

The procedure is generally stored in the memory of the control module 120, typically as a software routine. The software routine may also be stored and/or executed by a second CPU (not shown) that is remotely located from the hardware being controlled by the control module 120. Although the procedure or parts are discussed as being implemented as a software routine, some of the disclosed method steps may be performed in hardware as well as by the software controller, or manually. As such, the invention may be implemented in software as executed upon a computer system, in hardware as an application specific integrated circuit, or other type of hardware implementation, manually, or a combination of software, hardware, and/or manual steps.

In another embodiment, the control module 120 of the material delivery system includes, but is not limited to, one or more of the following components either individually or in a combination of two or more: Interface screen such as a standard or touch screen; Input device such as buttons, mouse, keyboard, touch screen, PLC or other control device; Connection between devices such as direct integration, interconnect cable, Ethernet network; Communication router/modem for connecting to a remote location via land line Telco line, internet or other wireless data network; MODBUS or other hardwire connection for connection to the control room or other central location of the plant where the unit is being used; Power supply for providing electrical power to the electrical devices; Solenoid valves, relays, etc. which are connected to either the PLC or central processing unit which are capable of modulating the position of the valves as well as read the input data from the various sensors and other devices connected to the unit; and or antenna of communication of router/modem to internet or other wireless data network.

Referring back to FIG. 9A, in one embodiment, the material delivery system 300 with one or more mixers 204 configured to sufficiently mix the material with an activating agent includes a material storage container 320 coupled to a metering device 308. The metering device 308 is coupled to the control module 120 so that an amount of material dispensed to the unit or units 302 may be monitored and/or metered. In one embodiment, the material storage container 320 is a container adapted to store material therein at substantially atmospheric pressures and has an operational pressure from about zero to about 30 pounds per square inch. The material storage container 320 has a fill port 346 and a discharge port 344. The discharge port 344 is connected to the inlet 370 of the delivery vessel 310 and is typically positioned at or near a bottom of the material storage container 320.

The metering device 308 is coupled to the discharge port 344 to control the amount of material transferred from the material storage container 320 to the delivery vessel 410 through a material delivery line or inlet 370. The metering device 308 may be a shut-off valve, rotary valve, mass flow controller, pressure vessel, flow sensor, positive displacement pump, or other device suitable for regulating the amount of material dispensed from the material storage container 320 into the delivery vessel 410 for injection into the unit 302. The metering device 308 may determine the amount of material supplied by weight, volume, time of dispense, or by other means. Depending on the material requirements of the unit 302, the metering device 308 may be configured or programmed to provide the desired amount of material or combination of materials. For example, when a unit 302 includes a biofuel unit, the metering device 308 may be configured or programmed to provide such as from about 2.2 kg to about 180 kg per day of additive-type catalysts (process control catalyst) or from about 1000 kg to about 20,000 kg per day of main catalyst. The metering device 308 typically delivers catalysts over the course of a planned production cycle, typically 24 hours, in multiple shots of predetermined amounts spaced over the production cycle. However, catalysts may also be added in an "as needed" basis or in a shot pot, as depicted in FIG. 9A. In another embodiment, when the unit 302 includes biofuel unit, the metering device 308 may be configured or programmed to provide such as from about 2.2 kg to about 180 kg per day of catalyst to a unit. In an embodiment, the metering device 308 is a control valve 332 that regulates the amount of material dispensed from the catalyst storage container 320 to the unit 302 by a timed actuation. Control valves suitable for use as a metering device are available from InterCat Equipment Inc., located in Sea Girt, N.J.

In a particular embodiment, the delivery vessel 410 is rigidly coupled to the mounting surface 304, as load cells are not needed to determine the weight of the delivery vessel 410 in this embodiment. The term "rigidly" include mounting devices, such as vibration dampers and the like, but excludes mounting devices that "float" the pressure vessel to facilitate weight measurement thereof. When the delivery is vessel is designed to dispense the entire vessel content and a zero calibration check may be performed, the delivery vessel may be mounted or unmounted. In one embodiment, the delivery vessel 410 has an operational pressure of about 0 to about 6.9 barg, and is coupled to a fluid source (e.g., a blower or compressor 108) by a first conduit 318. The first conduit 318 includes a shut-off valve 316 that selectively isolates the fluid source from the delivery vessel 410. A second conduit 328 couples the delivery vessel 410 to the unit 302 and includes a second shut-off valve 332 that selectively isolates the delivery vessel 410 substantially from the unit 302. The shut-off valves 316 and 332 are generally closed to allow the delivery vessel 410 to be filled with material from the material storage container 320 at substantially atmospheric pressure. In one embodiment, the controller or control module includes instructions, that when executed, prevent the pressure control valve and the discharge valve from simultaneously being in an open state.

Once the material is delivered into the delivery vessel 410, the control valve 342 is closed and the interior of the delivery vessel 410 is pressurized by a pressure control device 330 to a level that facilitates injection of the material from the delivery vessel 410 into the unit 302, typically at least about 20 pounds per square inch. After the loaded delivery vessel 410 is pressurized by the pressure control device 330, the shut-off valves 316 and 332 are opened, allowing air or other fluid provided by the fluid source (e.g., blower or compressor 108) to enter the delivery vessel 410 through the first conduit 318 and carry the material out of the delivery vessel 410 through the second conduit 328 to the unit 302 through the process line 122. In one embodiment, the fluid source provides air at about 60 to about 100 psi (about 4.2 to about 7.0 kg/cm2).

In operation, the material delivery system 400 periodically dispenses a known quantity of material into one or more units 302. Material is filled into the low pressure material storage container 320 through the fill port 346 located in an upper portion of the material storage container 320. The weight of the storage vessel, including any material residing therein, is obtained by interpreting data obtained from the load cells 350.

In one embodiment, a predefined quantity of material in the catalyst storage container 320 is transferred into the delivery vessel 410 by selectively opening the control valve 342 for a defined amount of time. After the material has been transferred, the weight of the catalyst storage container 320 is obtained once again, and the exact quantity of dispensed material is determined by subtracting the current weight from the previous measurement. Once the material is transferred to the delivery vessel 410, the pressure inside the delivery vessel 410 is elevated by the pressure control device 330 to, typically, at least about 1.37 barg. After operating pressure is reached, valves 316 and 332 are opened. This allows fluid supplied by the fluid source, typically air at approximately 4.1 barg, to flow through the delivery vessel 410 and carry the catalyst to the unit 302 after mixing the catalyst i.e. material with the activating agent 220 in the mixer 204.

Advantages of the metering system include but are not limited to the following such as below. Bulk storage of the catalyst at high pressure is not required, thereby allowing the catalyst storage container 320 to be fabricated less expensively as compared to pressurized bulk storage containers of some conventional systems.

Sensors

Embodiments of material delivery system with one or more mixers 204 may also include one or more sensors. In an embodiment depicted in FIG. 9C, sensors 362 are mounted proximate the inlet ports 370 such that a determination of whether or not a specific hose 388 is connected to the inlet port 370 of the pressure vessel 392. If a hose 388 is not connected to the port 370, the specific valves(s) associated with that particular port 370 can be automatically locked so that catalyst is not released from that port. This locking may be performed on manually or automated using the control module 120. The locking of a specific port permits safer operation of the delivery system 390 and prevents release of materials into the environment. Furthermore, by taking only a specific port off-line, the delivery system 390 may continue to safely operate and provide material to the unit 302 such that the unit 302 can continue to operate without interruption or down time, in an automatic mode of operation. Once the sensor 362 indicates re-connection to the container/bin, the availability of material from the container 396 associated with that hose 388 is recognized by the control module 120. In one embodiment, the valves are capable of withstanding repeated cycling with streams containing abrasive materials, such as but not limited to, ceramic powders, clay, aluminum oxide, silicon oxide, zeolite, phosphorus oxide, or other high temperature reaction products.

If additional safety is required, a light, horn or other notification device can be activated to notify the operator to switch from inactive to active for the specific port 370 using the computer control module 120.

In another embodiment, a sensor 362 may be affixed to the end of the hose 388 coupled to the container 396. The sensor 362 is configured to provide the control module 120 with a metric indicative of at least one of the presence of the container or material disposed in the container. In one embodiment, the sensor 362 detects information provided on an RF readable tag 364 coupled to the container 396. The RF readable tag 364 may contain information relating to the unique identification of the container 396, such that the control module 120 may obtain information relating to the material inside that container 396. In another embodiment, the tag 364 may include information relating to the material inside container 396. Thus, utilizing the sensor 362, the control module 120 can confirm that a container 396 containing the correct material was coupled to the hose 388, thereby insuring that the correct material is injected into the unit 302 while minimizing the potential for operator error. It is contemplated that information from the sensors 362 and 362 may be utilized to lock the associated port 370 as described above. In another embodiment, the sensor 362 detects information provided on a bar code coupled to the container 396. In yet another embodiment, the sensor 362 detects information provided on an RF readable tag 364 and or bar code coupled to the container 396

Referring to FIG. 9A, the material delivery 400 with one or more mixers 204 may also include one or more sensors for providing a metric suitable for determining the amount of material passing through the metering device 308 during each transfer of material to the delivery vessel 410. Alternatively, the sensors may be configured to detect the level (i.e., volume) of material in the material storage container 320, the weight of material in the material storage container 320, the rate of material movement through the material storage container 320, discharge port 344, metering device 308, and/or material delivery line 334 coupling the container 320 and vessel 410, or the like. The dispense mechanism 280-comprise one or more such sensors 282 with one or more metering devices 308.

In an embodiment, the sensor includes a plurality of load cells 350 adapted to provide a metric indicative of the weight of material in the material storage container 320. The load cells 350 are respectively coupled to a plurality of legs 348 that support the material storage container 320 above a mounting surface 304. Each of the legs 348 has one of the plurality of load cells 350 coupled thereto. From sequential data samples obtained from the load cells 350, the control module 120 may resolve the net amount of transferred material after each actuation of the metering device 308 (e.g., the control valve 342). Additionally, the cumulative amount of material dispensed over the course of the production cycle may be monitored so that variations in the amount of material dispensed in each individual cycle may be compensated for by adjusting the delivery attributes of the metering device 308, for example, by changing the open time of the control valve 342 to allow more (or less) material to pass there through and into the delivery vessel 410 for ultimate injection into the unit 302.

In another embodiment, the sensor may be a level sensor (not shown) coupled to the material storage container 320 and adapted to detect a metric indicative of the level of material within the material storage container 320. The level sensor may be an optical transducer, a capacitance device, a sonic transducer or other device suitable for providing information from which the level or volume of material disposed in the material storage container 320 may be resolved. By utilizing sensed differences in the levels of material disposed within the material storage container 320 between dispenses, the amount of material dispensed may be resolved for a known storage vessel geometry.

In yet another embodiment, the sensor may be a flow sensor (not shown) adapted to detect the flow of material through one of the components of the material delivery system described herein. In one embodiment, the flow sensor may be a contact or non-contact device and may be mounted to the material storage container 320 or the material delivery line 334 coupling the material storage container 320 to the delivery vessel 410. For example, the flow sensor may be a sonic flow meter or capacitance device adapted to detect the rate of entrained material (i.e., catalyst) moving through the material delivery line 334.

An embodiment further includes a material delivery system 1000 having a delivery vessel 1006 coupled to a preloader 1004. Optionally, the material delivery system includes one or more mixers 204 coupled to a delivery vessel 1006 and configured to sufficiently mix the material with an activating agent. The delivery vessel 1006 has one or more outlets, shown by two outlets 1064, 1066 in FIG. 10, and at least one metering device 1068 of a dispense mechanism interfaced with each outlets to control the amount of catalyst metered from the delivery vessel 1006. The delivery vessel 1006 includes at least one main fill port 1076 for bulk filling the delivery vessel 1006 with material, such as catalyst or other material. In one embodiment, the delivery vessel 1006 may include a separator 620 for establishing one or more compartments within the delivery vessel 1006, for example, to prevent mixing of material 1010A and material 1010B within the delivery vessel 1006. The metering device 1068 may include valves for controlling the flow of catalyst from the delivery vessel 1006. A control module 1072 is provided, that in conjunction with information indicative of a change in amount of material disposed in the delivery vessel 1006 provided by a sensor of the dispense mechanism (such as load cells 1060 supporting the delivery vessel 1006) and by operation of the metering device 1068, meter catalyst from the delivery vessel 1006 through the outlets 1064, 1066 to the one or more units 302, optionally through the mixer 204. The metering device 1068 may be configured as any of the metering devices 308 described herein, or other alternative suitable for providing discreet metered amounts of catalyst to the unit 302.

The metering devices 1068 coupled to the outlets 1064, 1066 are coupled to the unit 302 optionally through the mixer 204. A blower or compressor 108 (such as a gas source 256)

may assist moving the catalyst from the metering devices 1068 to the unit 302. In one embodiment, the gas source provides $N_2$.

In embodiments wherein an activating agent 220 is added to the material exiting the delivery vessel 1006, a mixer 204 is utilized. The activating agent 220 is provided to the material stream exiting the delivery vessel 1006 prior to entering the mixer 204. The activating agent 220 activates the catalyst in the mixer 204 as discussed above prior to entering the unit 302.

In one embodiment, the pre-loader 1004 includes sealable container, such a shot pot, which is coupled to an inlet port 1077 of the delivery vessel 1006. There is an automatic valve 1078 on the fill port 1077 controlled by the control module 1072. An operator manually loads an amount of catalyst into the pre-loader 1004. The operator then tells the control module 1072 communicating with the material delivery system 1000 to transfer the catalyst present in the pre-loader 1004 into the unit 302, through the delivery vessel 1006 and mixer 204. The control module 1072 then causes, through valve actuation and pressure/vacuum control, the pressure in the pre-loader 1004 to be adjusted (if necessary) so that the catalyst in the pre-loader 1004 to be sucked, blown or otherwise transported into the delivery vessel 1006. In one embodiment, the pressure within the pre-loader 1004 is raised to between to about 5 to about 80 pounds per square inch (about 0.35 to about 5.6 kg/cm$^2$) during dispensing operations by a pressure controller 1074. Alternatively, the pressures with the delivery vessel 1006 and the pre-loader 1004 may be set to have a differential sufficient to facilitate movement of the material from within the pre-loader 1004 to the delivery vessel 1006. The pressure controller 1074 may intermittently vent the delivery vessel 1006 to about atmospheric pressure to accommodate recharging the delivery vessel 1006 with catalyst through the second fill port. After catalyst transfer, the valves controlling flow in the conduit coupling the pre-loader 1004 to the delivery vessel 1006 to be closed, so that the environment of the pre-loader 1004 is isolated from vessel 1006 now containing the catalyst. The delivery vessel 1006 is then weighed or otherwise interfaced by the sensor to determine the amount of catalyst in the delivery vessel 1006. The controller 1074 then utilizes this information to meter a known quantity of catalyst (e.g., some or all of the catalyst) into the unit 302 from the delivery vessel 1006 through the mixer 204.

Non limiting advantages include but are not limited to below. The timing of when catalyst was or is added to the unit is known. The amount of catalyst added is known, such that any spillage by the operator is taken into account. The shot pot can be preloaded at any time, so that the control module can be triggered to add catalyst to the unit only when required. Such features allow better use of operator time by enabling the shot pot filling to be done at a free moment or as desired, not just in an emergency. Safety is improved by minimizing the risk of the operator accidentally pressurizing the shot pot when the top is still open, spraying himself with potentially Another embodiment optionally includes a multiple vent valve arrangement 1080 that allows a system full of catalyst to be vented in a controlled manner without losing too much catalyst in the process. Optionally, one or more mixers 204 coupled to a delivery vessel and configured to sufficiently mix the material with an activating agent. Benefit includes preventing the face velocity of a filter 1082 coupled to the delivery vessel 1006 via the multiple vent valve arrangement 1080 from exceeding design limits during the automatic venting process. This extends filter life very significantly. U.S. Pat. No. 6,358,401 is incorporated in by reference entirety.

Figure 10A:
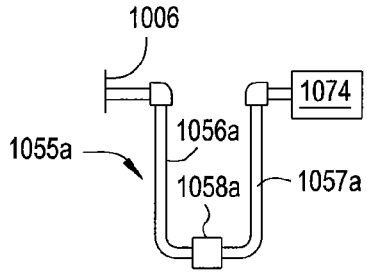
FIG. 10A is a schematic diagram of a double flex hose connection coupling a delivery vessel of a material delivery system to a pressure controller in accordance with an embodiment of the invention.
Figure 10:
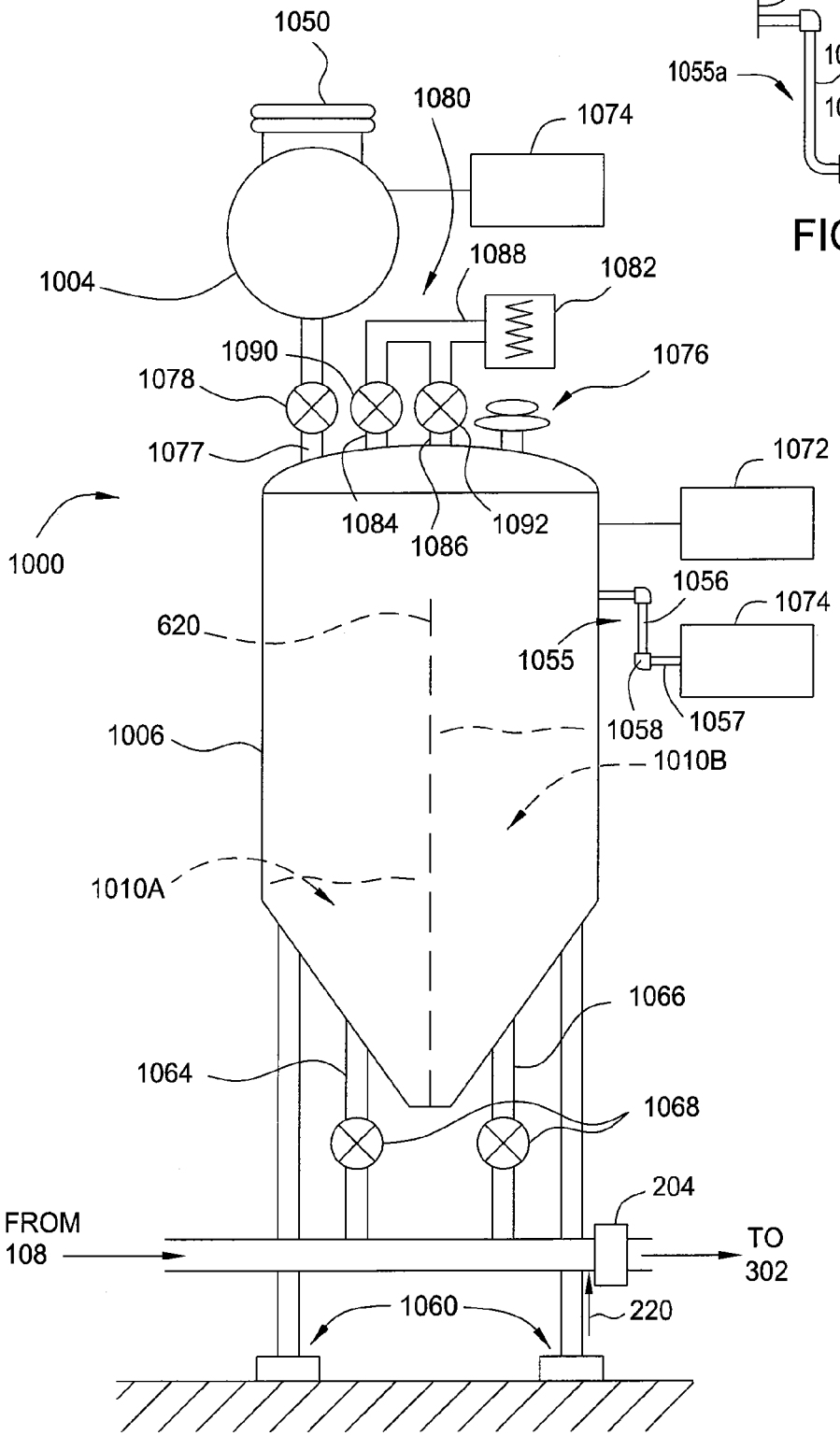
FIG. 10 is a schematic diagram of a material delivery system with pre-loader and multiple vents in accordance with an embodiment of the invention.

One embodiment of a multiple vent valve arrangement 1080 coupled to a vessel 1006 is depicted in FIG. 10. The multiple vent valve arrangement 1080 may be adapted for use with various loader and/or vessels as described above or other material addition system require venting through a filter. An embodiment of the multiple vent valve arrangement 1080 includes a plurality of vents having at least a first vent line 1084 and a second vent line 1086 coupled to a filter 1082, such as a sintered metal filter. In the embodiment depicted in FIG. 10, the vent lines 1084, 1086 are coupled to a common line 1088 that is coupled to the inlet of the filter 1082. Each vent line 1084, 1086 is coupled the interior volume of the delivery vessel 1006. Each vent line 1084, 1086 has a valve 1090, 1092 for controlling the flow through the respective line 1084, 1086.

The first vent line 1084 and/or valve 1090 disposed in series is configured to have a flow restriction less than the flow restriction through the second vent line 1086 and/or valve 1092. By controlling the relative restrictions in view of the amount gas and pressure needed to vent from the delivery vessel 1006, the velocity through the filter 1082 may be maintained at or below a predetermined range, such as an optimum filtering velocity and/or a velocity that prevents damage to the filter 1082. In one embodiment, the flow restriction may be controlled by first utilizing a smaller diameter for the first vent line 1084, and once the pressure as reduces to a level indicative of a sufficiently reduced flow rate, the first valve 1090 is closed and the second valve 1092 is opened, allowing flow through the second vent line 1086 which is configured with a diameter greater than the diameter of the first vent line 1086.

In operation, the delivery vessel 1006, when at a higher pressure, would be vented through the line having the greater flow restriction so that the velocity through the filter is maintained below a predefined level. Once the pressure in the delivery vessel 1006 has been reduced to a predetermined level, the flow through the line having the greater flow restriction is shut off and flow is started through the line having the lower flow restriction. The predetermined level is selected to so that flow through the lower flow restriction will not exceed a desired velocity through the filter 1082. Optionally, once the pressure in the delivery vessel 1006 has been further reduced to a second predetermined level, the flow through the line having the greater flow restriction is allowed along with flow through the line having the lower flow restriction, so that the combined flow allows faster venting of the delivery vessel 1006. The second predetermined level is selected to so that the combined flow through the both lines will not exceed a desired velocity through the filter 1082.

Figure 11:
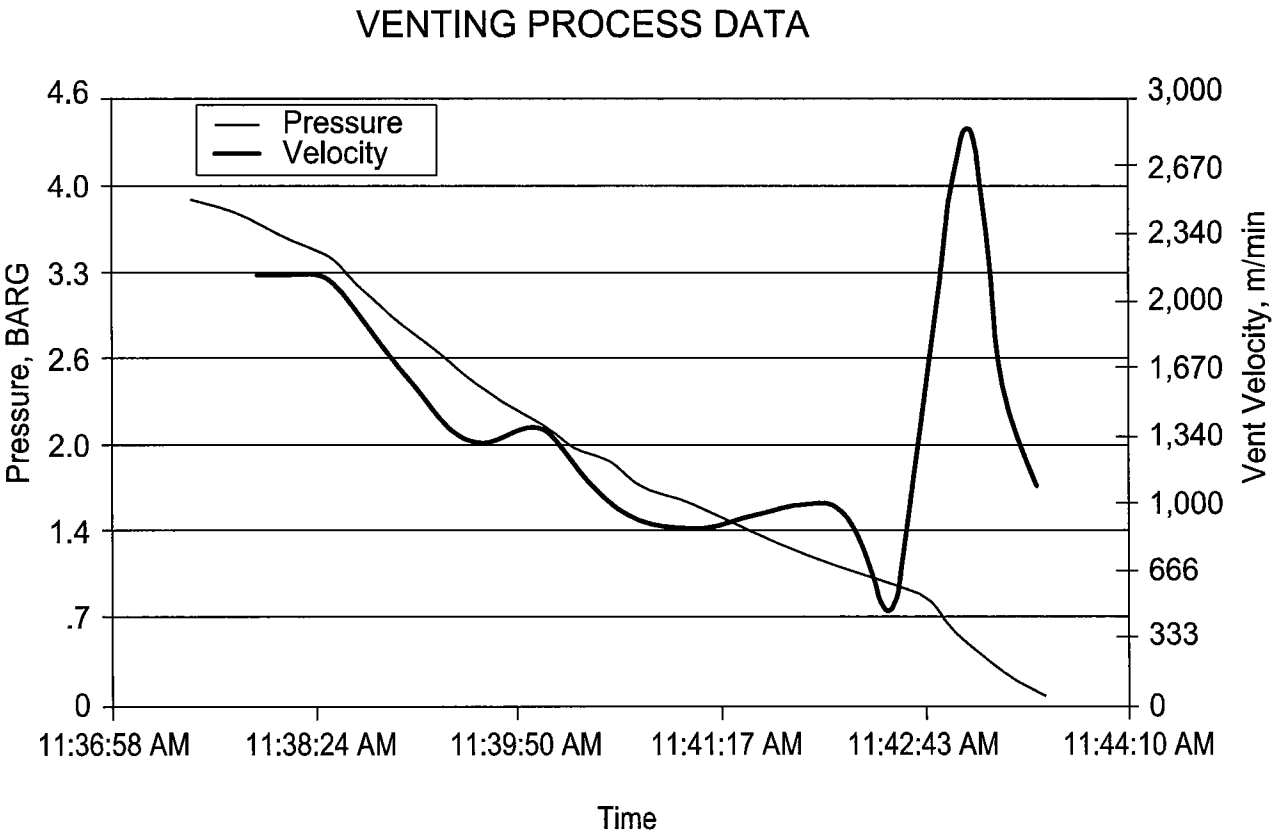
FIG. 11 is a chart of a material delivery system with multiple vents in accordance with an embodiment of the invention.

An embodiment includes one or more restrictions in one or more vent lines to control the face velocity through the filter 1082 during venting. An embodiment includes: a first valve 1090 having a first flow restriction (which may or may not be an orifice plate or valve) allowing a first flow through the first valve 1090 such that velocity of gas across surface of the filter 1082 does not exceed a maximum indicated velocity. An embodiment further includes second valve 1092 having a second flow restriction (which may or may not be an orifice plate or valve) allowing a second flow through the second valve 1092 such that velocity of gas across the surface of the filter 1082 does not exceed a maximum indicated velocity. The following example shows data from such a system before the restrictions were put in place to control velocity. FIG. 11 illustrates an example showing data from such a system before the restrictions were put in place to control velocity. As shown in the example of FIG. 11, when the second valve 1092 was opened at 12 psig, the velocity increased as the flow through the second vent line 1086 was configured with less restriction than the first vent line 1086, thereby allowing faster venting times without exceeding a desired face velocity of the filter 1082. Once the restrictions were calculated and put in place the vent velocity remained below 7,000 ft/min at all times. Note that this 7,000 ft/min is in the vent line, not the actual filter face velocity. This example is given for illustrative purposes only. During the refilling process the control module 1072 monitors the rate of weight increase in the delivery vessel 1006 to confirm that catalyst is flowing. If the weight stops increasing, the control module 1072 then looks at the vacuum level. If the vacuum level is high, then the loading line coupled to the main fill port 1076 is likely blocked, and an alarm is sounded. If the vacuum level is low, this indicates that the tote bin (not shown) coupled to the main fill port 1076 is empty of catalyst. The control module 1072 can then determine that the refill of the delivery vessel 1006 is complete and catalyst delivery to the unit 302 may resume. The control module 1072 can intelligently decide when to refill each compartment of the delivery vessel 1006. Let us take the example where the level that normally trips an automatic refill is 100 lbs, and there are currently 100 lbs in compartment A (shown as filled with material 1010A), and 150 lbs in compartment B (shown as filled with material 1010B). In this case, the control module 1072 may decide to wait for the material 1010B in compartment B to drop to 100 lbs before initiating a refill of A. Compartment A will still have some material 1010B in it at this point, but will be well below its own 100 lbs set point. By waiting for the level in B to drop in this way, the control module 1072 can refill both materials 1010A and 1010B at the same time, minimizing the amount of time that the system 1000 is unable to add material to the FCC or other process unit. There are process credits for this, and it also minimizes utility (air) consumption.

Although illustrated in the embodiment of FIG. 10, any of the embodiments herein may be equipped with a double flex hose connection 1055. The double flex hose connection 1055 substantially prevents forces generated by flex hoses (such as those utilized to couple gas, utilities, catalyst fill, catalyst outlets or other piping/conduits to the delivery vessel 1006) from acting on the metering device 1068 in a manner that may corrupt the weight measurements utilized in determining the amount of material metered from the delivery vessel 1006. The forces generated by flex hoses are typically due to changes in temperature, pressure and volume of material flowing through the hoses which may cause the hose to move laterally and/or axially. It is also contemplated that a double flex hose connection may be utilized to isolate forces from being applied to an object in other applications.

In the embodiment depicted in FIG. 10, the double flex hose connection 1055 is utilized to couple the pressure controller 1074 to the delivery vessel 1006. Although not shown, other conduits may be coupled to the delivery vessel 1006 by a double flex hose connection 1055. Optionally, one or more mixers 204 may be coupled to the delivery vessel 1006 and configured to sufficiently mix the material with an activating agent. In the exemplary embodiment, the double flex hose connection 1055 includes a first flex hose 1056 and a second flex hose 1057 coupled by a connector 1058. The connector 1058 couples the hoses 1056, 1057 in a perpendicular orientation or other orientation which decouples the forces generated by hose movement from the delivery vessel 1006. The first flex hose 1056 is coupled at a first end to the delivery vessel 1006 and at a second end to the connector 1058. The connector 1058 may be an NPT elbow or other suitable hose coupling device which maintains a substantially perpendicular orientation of the flex hoses 1056, 1057. The connector 1058 may optionally be comprised of multiple components and even intervening hoses and/or conduits. The second flex hose 1057 is coupled at a first end to the connector 1058 and at a second end to the pressure controller 1074 (or hard conduits coupled to the pressure controller 1074). In the exemplary embodiment, the first flex hose 1056 hangs from the delivery vessel 1006 in a substantially vertical position, while the second flex hose 1057 extend from the connector 1058 in a substantially horizontal position. In this orientation, axial expansion of the first flex hose 1056 is accommodated by lateral movement (flexing) of the second flex hose 1057 while axial expansion of the second flex hose 1057 is accommodated by lateral movement (flexing) of the first flex hose 1056, thereby preventing any forces associated with hose expansion (or contraction) from being transferred to the delivery vessel 1006 where it could corrupt the calculation of material begin dispensed from the delivery vessel 1006. Of course, alternatively the first flex hose 1056 may be maintained in a horizontal position while the second flex house 1057 may be maintained in a horizontal position.

In an alternative embodiment depicted in FIG. 10A, the double flex hose connection 1055*a* may utilized to couple the pressure controller 1074 to the delivery vessel 1006 that includes a first hanging flex hose 1056*a* and a second hanging flex hose 1057*a* coupled by a connector 1058*a*. The connector 1058*a* couples the hoses 1056*a*, 1057*a* in a substantially parallel hanging orientation. The first flex hose 1056*a* is coupled at a first end to the delivery vessel 1006 and at a second end to the connector 1058*a*. The second flex hose 1057*a* is coupled at a first end to the connector 1058*a* and at a second end to the pressure controller 1074 (or hard conduits coupled to the pressure controller 1074). In the exemplary embodiment, the first flex hose 1056*a* hangs from the delivery vessel 1006 in a substantially vertical position, while the second flex hose 1057*a* hang in a substantially vertical position from the connector 1058 (or piping leading to the controller 1074). In this orientation, axial expansion of either flex hose 1056*a*, 1057*a* is accommodated by lateral movement (flexing) of the other flex hose, thereby preventing any forces associated with hose expansion (or contraction) from being transferred to the delivery vessel 1006 where it could corrupt the calculation of material begin dispensed from the delivery vessel 1006.

Figure 12:
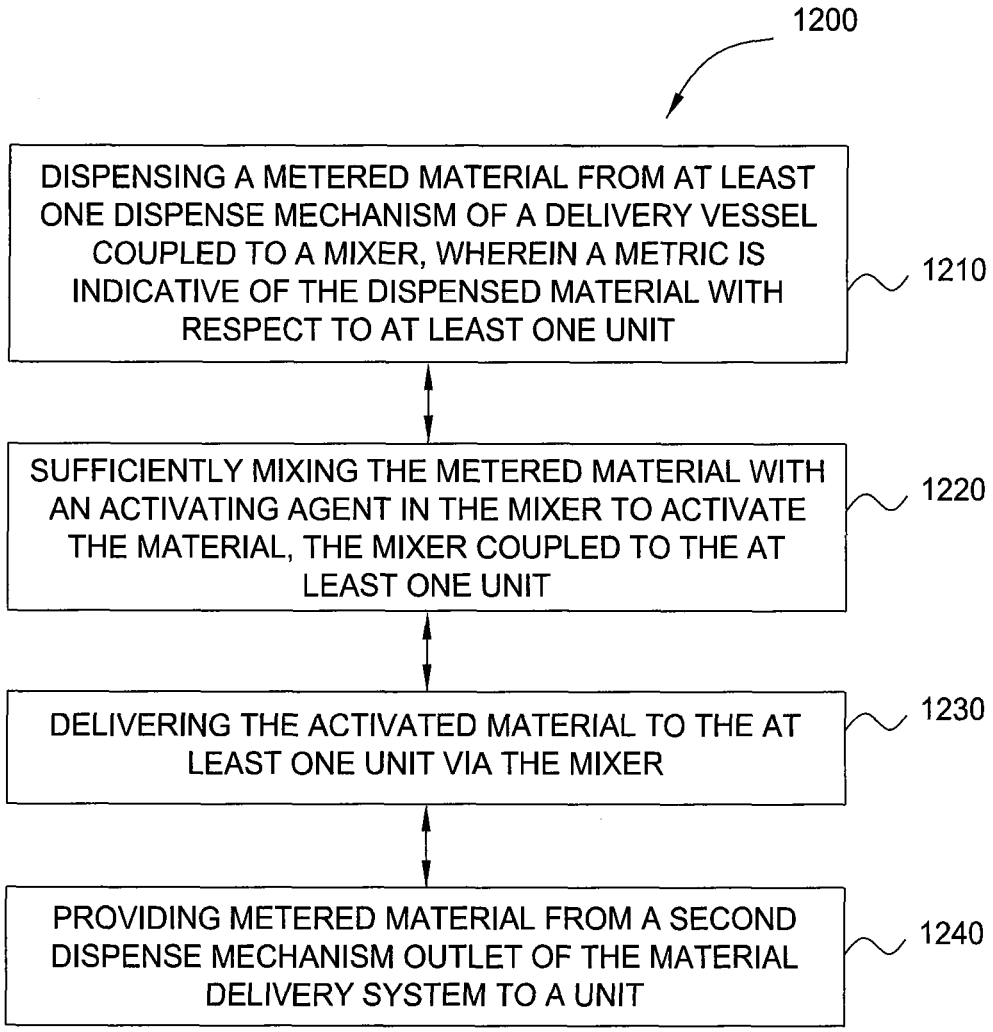
FIG. 12 is a flow diagram of a method of providing material to a unit in accordance with an embodiment of the invention.

The invention also encompasses methods of delivering a material i.e. catalyst, additive, equilibrium spent catalyst, catalyst fines, etc. FIG. 12 is a flow diagram of one embodiment of a method 1200 for delivering a material to one or more units. The method 1100 may be practiced with the material delivery systems described above, or other suitable delivery systems. The method includes Step 1210 includes dispensing a metered material from one or more dispense mechanisms of a delivery vessel coupled to one or more mixers 204, wherein a metric is indicative of the dispensed material with respect to at least a unit.

The metric of the material includes but is not limited to a metric such as the amount of material, detect the rate of material moving through a conduit of know area, volume of material, and weight of material in the material storage containers, compartment of vessel of the delivery system, either individually or a combination of two or more thereof. In one embodiment, the determination may be made by metric such as but not limited to weight. Examples of weight determination include based on a 'gain-in-weight' and or 'loss-in-weight' by the delivery vessel over the course of the material delivery.

Step 1210 may be repeated as many times as desired.

Step 1220 includes sufficiently mixing the metered material with an activating agent 220 such as described above in the mixer 204 to activate the material, the mixer 204 coupled to the at least one unit 302. Step 1230 includes delivering the activated material to the at least one unit 302 via the mixer 204.

Providing to multiple units 302 is optional and may be practiced in sequentially, simultaneously or in the alternative. Step 1240 optionally includes providing metered material from a second dispense mechanism of the material delivery system to a second unit or same unit 302.

The material exiting the outlets of the first and second dispense mechanisms may be of the same or different type of material. Switching of the connection of the first dispense mechanism from the first unit to the second unit may be accomplished in a number of suitable manners, for example, by changing the state of a selector or diverter valve 397. For example, at step 840, material from the second dispense mechanism of the delivery system may be provided to the first unit 302. Switching of the connection of the second dispense mechanism from the second unit to the first unit may be accomplished as described above.

Figure 13:
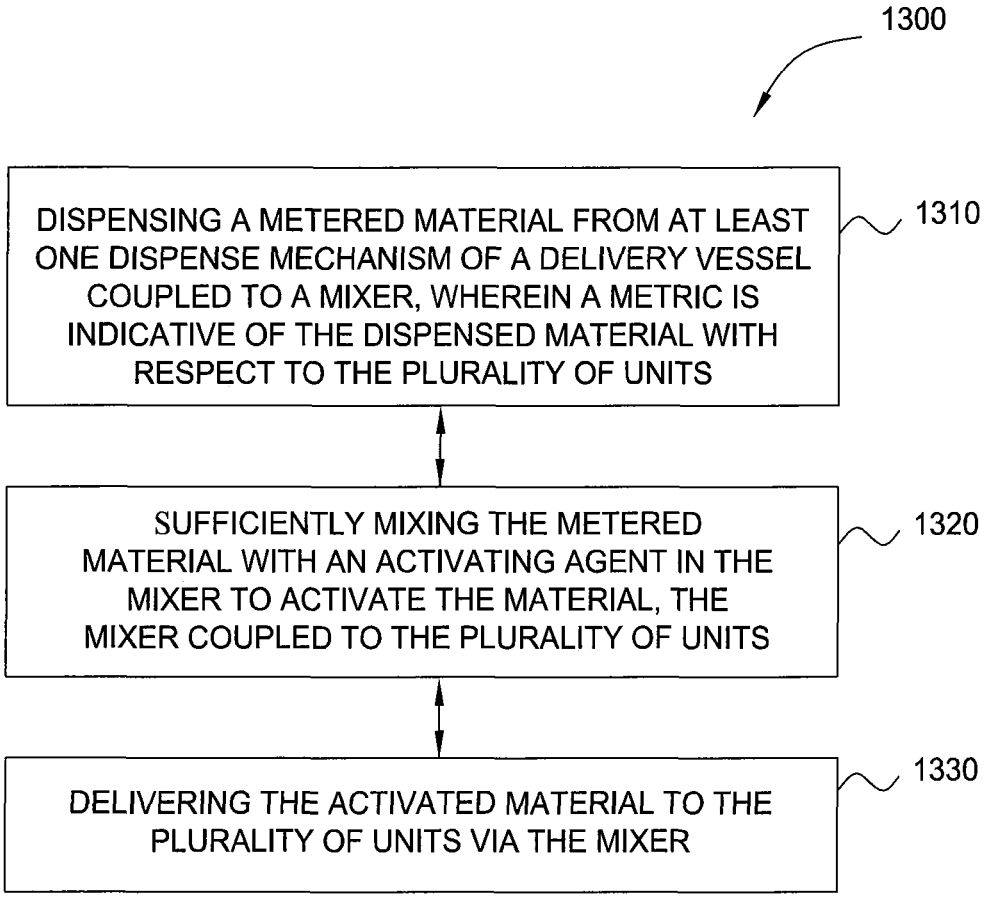
FIG. 13 is a flow diagram of another method of providing material to a plurality of units in accordance with an embodiment of the invention.

With reference to FIG. 13, next is described an embodiment of a method 1300 of providing a material to a plurality of units. Step 1310 included dispensing a metered material from at least one or more dispense mechanisms of a delivery vessel coupled to one or more mixers 204, wherein a metric is indicative of the dispensed material with respect to the plurality of units 302.

Step 1320 includes sufficiently mixing the metered material with an activating agent 220 in the one or more mixers 204 to activate the material, the mixer 204 coupled to the plurality of units 302. Step 1330 includes delivering the activated material to the plurality of units 302 via the one or more mixers 204.

The methods described are not limited by a sequence of when and how one or more materials are provided to the plurality of units 302. Materials may be dispensed to plurality of unit simultaneously or sequentially. Nor are the methods limited by the sequential order or frequency of the delivery of the material or materials to the plurality of units.

The methods described allow delivery of materials to one or more units 302 as needed, simultaneously or sequentially. For example, in one embodiment, the materials may differ from each other such as wherein one material may control emissions and another material may control the resultant product mix produced by a unit. The multiple materials which may or may not differ from each other may be dispensed to the same unit or plurality of units 302. Controlling the delivery of multiple materials allows greater process flexibility with reduced capital expenditures.

Furthermore, another embodiment includes check and balance or calibration method of weighing catalyst output vs. catalyst input such that catalyst that is input in the delivery vessel should equal catalyst output dispensed by the vessel. Check and balance or calibration method of weighing catalyst output vs. catalyst input such that catalyst that is input in the delivery vessel should equal catalyst output dispensed by the delivery vessel does not per se require applying a known calibration force to the load cell and comparing a metric from the load cell of the known calibration with an expected metric. Embodiment of check and balance or calibration method of weighing catalyst output vs. catalyst input such that catalyst that is input in the delivery vessel should equal catalyst output dispensed does not require calibration by using a known calibration force to the load cell. Of course, further calibration by using a known calibration force to the load cell may be a particular non-limiting embodiment. A particular embodiment includes check and balance or calibration method of weighing catalyst output vs. catalyst input such that catalyst that is input in the delivery vessel should equal catalyst output dispensed by the vessel, wherein one or more mixers 204 are coupled to the delivery vessel and configured to sufficiently mix catalyst or material with an activating agent.

Another embodiment includes calibrating a metric provided by of a load cell(s) with an expected metric. The optional step may include automated load cell calibration by imparting a known force to a delivery vessel coupled to at least a load cell and determining if the at least one load cell accurately detects the known force imparted on the vessel. For example, a step may be added to the methods described to include calibrating or comparing a metric provided by of a load cell(s) with an expected metric of the known force. For example, refinery or bio fuel processes may continue without interruption while the load cells of a material delivery system coupled to one or more units are calibrated in between addition(s) of material(s) without having to shut down the material delivery system, thereby maintaining a material delivery system in an operational state and ready to dispense material to one or more units as soon as the calibration step has been completed. In a particular embodiment of automated load cell calibration device 340, one or more mixers 204 are coupled to the delivery vessel and configured to sufficiently mix catalyst or material with an activating agent 220.

If the difference between the compared metric is outside of a predetermined range, a service flag may be issued. If the difference is within operational tolerances, then the software adjusts at least one of the outputs of the load cell or the software algorithm so that the output reading of the load cells is indicative of the true force upon the load cell, and consequently, a more accurate determination of the transfer material may be made. The method may also include recording the metric of the known force imparted on the delivery vessel and determining any deviation between the recorded measured metric and known value.

The automated load cell calibrating may be conducted a plurality of times at desired frequency intervals and as many times based on the degree of accuracy and precision need or wanted for an industrial system and acceptable deviation ranges that are allowed for a given weight of material to be dispensed. The automated load cell calibrating can periodically apply an equivalent weight to the delivery vessel and determine any deviation while continuing to dispense catalyst. In another embodiment, the automated load cell calibrating may impart an equivalent weight to the delivery vessel and monitor any deviation regular on periodic basis, such as per dose, per hour, per day, per week, etc. In another embodiment, method includes automated load cell calibrating each delivery of a material to an industrial process to check for accuracy of the amount of catalyst dispensed.

Corrective action with respect to any deviation between the measured metric and known metric of the amount of material may also be performed. Corrective actions include, but are not limited to, adjusting any deviation between the measured weight and known metric of the material in proportion to the ratio of the deviation between the measured weight and known metric of the material, adjusting the load cell downward to equal the known value of the force imparted on the vessel, adjusting the load cell upward to equal the known metric of the material, adjusting at least a subsequent delivery of a material into one or more units 302 based on the deviation. Corrective action may also include introducing, during a subsequent basic cycle time, an amount of the material which is less than the nominal addition amount when the measured weight is less than the known metric of the material or introducing, during a subsequent basic cycle time, an amount of the material which is more than the nominal addition amount when the measured weight is greater than the known value of force imparted.

The methods above may further include one or more of the following optional step of integrating with an off-site computer database system. The information concerning any deviation between the measured metric and the known metric of the material may be sent to a remote control center outside of a unit. For example, communication may be established between a control module of the material delivery system and a remote device in response to an event. Non-limiting examples of 'remote device' include such as but not limited to, a server or any computer terminal that interacts with the system via the Internet, a computer terminal located or accessed by a catalyst supplier or the production facility's inventory controller/planner, a lap top computer or PDA that is brought within communication range, etc.

The computer controller of the embodiments of the invention can be linked via land-line Telco, wireless modem, internet connection, etc. to a central server which can maintain the various parameters of the embodiments of the disclosed material addition system. The notifications of injection of materials, deviations in measurement of known weight, etc. can either be made by the material addition system itself, or via an externally connected computer system. Furthermore, the off-site external system can permit parameters within the material addition system control module to be changed without a person physically being required to be on-site at the control module unit.

Another option is tracking of injected material, i.e., product, can also be accomplished with the embodiments of the disclosed material addition system by sending data about a specific catalyst, date, time, amount of addition, back to the central database which further integrates with the previous usage of the catalyst as well as shipments to the specific location. From this inventory reconciliation, features such payment upon-delivery can be accomplished as well as notification to reorder upon reaching a minimum quantity threshold for a specific location/unit. Data can be removed from the disclosed embodiments of the invention systems via a variety of means. Data can be physically extracted via on-board USB or other type of memory storage device. Alternatively, data can be sent via electronic means over the internet or via a secure data network within the processing unit or externally via land-line Telco line, wireless cellular network, etc. When data is sent via wireless cellular over the internet or other insecure means, then a virtual private network (VPN) may be employed. VPN technology, either hardware or software based, helps secure data transfers or communication between the material addition system control module and the home network.

An embodiment includes a system for providing one or more material into one or more units. The system includes: a material delivery system for providing material to one or more units; one or more mixers coupled to a delivery vessel and configured to sufficiently mix activating agent and material to activate material, an enclosure suitable for hazardous service; a control module disposed in the enclosure for controlling the additions made by the material delivery system; and a communication port coupled to the control module for communicating information regarding activity of the material delivery system to a device remote from the enclosure while the enclosure is sealed.

Another embodiment includes a storage vessel; a metering device coupled to the storage vessel and having an output adapted for coupling to the one or more units; one or more mixers coupled to a delivery vessel and configured to sufficiently mix activating agent and material to activate material, one or more sensor for providing a metric indicative of the amount of material dispensed into the metering device; an enclosure suitable for hazardous service; a control module disposed in the enclosure and having a memory device for storing catalyst injection information derived from the metric provided by the sensor; and a communication port coupled to the control module for communicating information stored in the memory device to a remote device while the enclosure is sealed.

Yet another embodiment includes a method for providing one or more materials into one or more units. The method includes: dispensing material for a material delivery system into one or more units through a mixer coupled to the delivery vessel and configured to sufficiently mix material with activating agent to activate material; storing a record of system activity indicative of the amount of material in a memory device disposed in an enclosure suitable of hazardous duty; and accessing the stored record from the enclosure while the enclosure remains sealed.

Another embodiment includes a material delivery system for metering material to a plurality of units. The material delivery system includes an enclosure suitable for hazardous locations, a low pressure storage vessel having one or more mixers coupled thereto, the one or more mixers configured to sufficiently mix activating agent and material to activate material; a pressure vessel having an outlet adapted to be coupled to the plurality of units and an inlet coupled to the low pressure storage vessel; at least one sensor adapted to provide a metric indicative of material transferred from the low pressure storage vessel to the pressure vessel; and a control module disposed in the enclosure for controlling material transferred from the pressure vessel to the plurality of units, wherein the control module configured for communicating information regarding activity of the apparatus to a device remote from the enclosure while the enclosure is sealed.

Another embodiment of the material delivery system includes a low pressure storage vessel, a pressure vessel rigidly coupled to a supporting surface having an outlet adapted to be coupled to the one or more units and an inlet, one or more mixers coupled thereto, the one or more mixers configured to sufficiently mix activating agent and material to activate material, a pressure control device coupled to the pressure vessel and configured to selectively pressurize the pressure vessel relative to the low pressure storage vessel, a metering device coupling the storage vessel to the inlet of the pressure vessel, an enclosure suitable for hazardous service; a control module disposed in the enclosure for controlling injections made from the low pressure storage vessel, and a communication port coupled to the control module for communicating information regarding activity of the apparatus to a device remote from the enclosure while the enclosure is sealed. The information transmitted may be at least one of an amount of material injected into the unit, error messages from the control module, a record of operator interface with the control module, times of manually interrupting of apparatus operation, times of program resumption, additions that are made manually which are in addition to any automatically controlled additions, record of how much material is left in the low pressure storage vessel, a record of how much material is available to replenish the low pressure storage vessel, or a communication regarding material inventory.

Another embodiment includes a method for monitoring a material delivery system. The method includes automatically updating a material available inventory information in a digital memory device in response to a predetermined event; automatically determining a sufficiency of the material available inventory; and taking a re-supply action in response to a determination of insufficient material available inventory.

Another embodiment of the material delivery system includes: a storage vessel; a metering device coupled to the storage vessel and having an output adapted for coupling to the one or more units; one or more mixers coupled thereto, the one or more mixers configured to sufficiently mix activating agent and material to activate material; at least one sensor for providing a metric indicative of the amount of material dispensed through the metering device; an enclosure suitable for hazardous service; a control module disposed in the enclosure and having a memory device for storing catalyst injection information derived from the metric provided by the sensor; and a communication port coupled to the control module for communicating information stored in the memory device to a remote device while the enclosure is sealed.

Another embodiment includes a method for monitoring a material delivery system. The method includes one or more of the following steps: determining an occurrence of a predefined event associated with the material delivery system; sufficiently mix activating agent and material to activate material in a mixer coupled to the vessel; establishing communication between a control module of the material delivery system and a remote device in response to the event, wherein the remote device is remote from the material delivery system; and wherein the step of establishing communication comprises transmitting information to the remote device in response to a predefined event; and information comprises automatically submitting a reorder request for material if a material inventory level is below a predefined threshold; and transmitting information relating to the event between the remote device and control module. The threshold dependent event may be at least one of a blocked or impeded discharge port, a pressure deviation in a storage vessel, a pressure deviation within the injection system, a pressure deviation within a pressure control system, a deviation in the flow of material from the material delivery system, a deviation from a planned material injection schedule, a temperature deviation within the storage vessel, or a temperature deviation within the material delivery system.

Another embodiment includes a method for monitoring a material delivery system. The method includes communicating with a memory device of a control module of the material delivery system adapted to control an amount of material dispensed into a unit through one or more mixers coupled to a vessel of the delivery system, the memory device having material usage information; and determining if material inventory needs to be replenished by steps comprising: utilizing material usage information from the memory device to determine an available material inventory; and comparing the available material inventory with a reorder level.

Another embodiment includes a method for monitoring material requirements of a material system. The method includes one or more of the following steps: dispensing material from the material delivery system; sufficiently mixing metered material with one or more activating agents to activate material in a mixer coupled to the unit; automatically updating material available inventory information of a plant in a digital memory device in response to the dispensing step; and automatically determining a sufficiency of the material available inventory of the plant. The method may further optionally include taking a re-supply action in response to a determination of insufficient catalyst available inventory of the plant.

Another embodiment includes a method for monitoring catalyst requirements of one or more units 302. The method includes one or more of the following steps:

dispensing material from the material delivery system; sufficiently mixing metered material with one or more activating agents to activate material in a mixer coupled to the unit; automatically updating a material available inventory information of a plant in a first digital memory device of the material delivery system in response to the dispensing step; transferring the material available inventory information of the plant from the first digital memory device to a second digital memory device accessible from a control room of the site at which the material delivery system is located; and automatically determining a sufficiency of the material available inventory of the plant. The method may further optionally include taking a re-supply action in response to a determination of insufficient catalyst available inventory of the processing unit.

Another embodiment of a method includes: sufficiently mixing metered material with one or more activating agents to activate material in a mixer coupled to one or more units; obtaining data concerning one or more respective units in order to establish:

(1) an upper concentration limit for activated material which is capable of producing the desired performance from the one or more respective units, (2) a lower concentration limit for the activated material which is capable of producing the desired performance from the one or more respective units, (3) a rate of consumption of the material by the one or more respective units, and (4) an addition rate at which material is introduced into the one or more respective units;

entering the data concerning the one or more respective units into a programmed computer in order to determine: (1) a basic cycle time for introducing an addition amount of the material into the one or more respective units, (2) a first period of the basic cycle time wherein the addition amount of the material is introduced into the one or more respective units, (3) a second period of the basic cycle time wherein the material is not introduced into the one or more respective units, (4) an addition amount of the material which is capable of raising the concentration of the material from the lower concentration limit to the upper concentration limit and which also is capable of being introduced into the one or more respective units during the first period of the basic cycle time, given the addition rate at which material is introduced into one or more respective units, placing the one or more respective units under control of a computerized control device and thereby: (1) operating the one or more respective units for a given period of time which contains a series of basic cycle times, (2) introducing a nominal weight of material sufficiently mixed with an activating agent to activate the material into the one or more respective units during the first period of a given basic cycle time at an addition rate of from about three times to about ten times the rate of consumption of the material by the one or more respective units, (3) determining a weight difference between the nominal weight of the nominal addition amount and an actual weight of the material introduced into the one or more respective units; (4) sending analog information concerning the weight difference between the nominal weight of the nominal addition amount and the actual weight of the material introduced into the one or more respective units to the computerized control device in order to take any needed corrective action with respect to subsequent introduction of the material into the one or more respective units.

Another embodiment for controlling and maintaining addition of a material to one or more units comprise: sufficiently mixing metered material with one or more activating agents to activate material in a mixer coupled to the one or more units; (I) obtaining data concerning the one or more respective units in order to establish: (1) an upper concentration limit for the material which is capable of producing the desired performance from the one or more respective units, (2) a lower concentration limit for the material which is capable of producing the desired performance from the one or more respective units, (3) a rate of consumption of the material by the one or more respective units, and (4) an addition rate at which material is introduced into the one or more respective units; (II) entering the data concerning the one or more respective units into a programmed computer in order to determine: (1) a basic cycle time for introducing an addition amount of the material into the one or more respective units, (2) a first period of the basic cycle time wherein the addition amount of the material is introduced into the one or more respective units, (3) a second period of the basic cycle time wherein the material is not introduced into the one or more respective units, (4) an optimal addition amount of the material which is capable of raising the concentration of the material from the lower concentration limit to the upper concentration limit and which also is capable of being introduced into the one or more respective units during the first period of the basic cycle time, given the addition rate at which material is introduced into the one or more respective units, and (5) a non-optimal addition amount of the material which is capable of changing the concentration of the material in the one or more respective units in response to an analog signal produced by the one or more respective units when said the one or more respective units does not produce the desired performance through use of the optimal addition amount of the material; (III) placing the one or more respective units under control of a computerized control device and thereby: (1) operating the one or more respective units for a given period of time which contains a series of basic cycle times, (2) introducing an optimal addition amount of the material additive into the one or more respective units during the first period of a given basic cycle time by injecting said material additive into the one or more respective units at an addition rate which is between about three times and about ten times the rate of consumption of the material by said the one or more respective units, (3) determining that an optimal addition amount of the material is, in fact, introduced into the one or more respective units during the first period of the given basic cycle time by use of a determination method which includes weighing a container holding an inventory of material additive before and after said material is introduced into the one or more respective units, (4) sending analog information obtained by weighing the container holding the inventory of material additive to the computerized control device in order to evaluate corrective action with respect to subsequent introduction of material additive into the one or more respective units, and (5) taking corrective action by a procedure wherein a non-optimal addition amount of the material is introduced into the one or more respective units during a subsequent basic cycle time by virtue of the fact that an analog signal produced by the one or more respective units causes the computerized control device to substitute use of the optimal addition amount of the material with the use of the non-optimal addition amount of the material.

Another embodiment for controlling addition of a material into one or more respective units to maintain a given concentration of the material in the one or more respective units comprise: sufficiently mixing metered material with one or more activating agents to activate material in a mixer coupled to the one or more units; (I) obtaining data concerning the fluid catalytic cracking unit in order to establish: (1) an upper concentration limit for the material which is capable of producing the desired performance from the one or more respective units, (2) a lower concentration limit for the material which is capable of producing the desired performance from the one or more respective units, (3) a rate of consumption of the material by the one or more respective units, and (4) an addition rate at which material is introduced into the one or more respective units; (II) entering the data concerning the one or more respective units into a programmed computer in order to determine: (1) a basic cycle time for introducing an addition amount of the material into the one or more respective units, (2) a first period of the basic cycle time wherein the addition amount of the material is introduced into the one or more respective units, (3) a second period of the basic cycle time wherein the material is not introduced into the one or more respective units, (4) an optimal addition amount of the material which is capable of raising the concentration of the material from the lower concentration limit to the upper concentration limit and which also is capable of being introduced into the one or more respective units during the first period of the basic cycle time, given the addition rate at which material is introduced into the one or more respective units, and (5) a non-optimal addition amount of the material which is capable of changing the concentration of the material in the one or more respective units in response to an analog signal produced by the one or more respective units when said unit does not produce the desired performance through use of the optimal addition amount of the material; (III) placing the one or more respective units under control of a computerized control device and thereby: (1) operating the one or more respective units for a given period of time which contains a series of basic cycle times, (2) introducing an optimal addition amount of the material (having a nominal weight) into the one or more respective units during the first period of a given basic cycle time by injecting said material additive into the one or more respective units at an addition rate which is between about three times and about ten times the rate of consumption of the material additive by said the one or more respective units, (3) determining a weight difference between the nominal weight of the optimal addition amount and an actual weight of the material introduced into the one or more respective units by weighing a container holding an inventory of the material additive before and after the optimal addition amount is introduced into the one or more respective units, (4) sending analog information concerning a weight difference between the nominal weight of the optimal addition amount and the actual weight of the material additive introduced into the one or more respective units to the computerized control device in order to evaluate corrective action with respect to subsequent introduction of material additive into the one or more respective units, and (5) taking corrective action by a procedure wherein a non-optimal addition amount of the material is introduced into the one or more respective units during a subsequent basic cycle time by virtue of the fact that an analog signal produced by the one or more respective units causes the computerized control device to substitute use of the optimal addition amount of the material with use of the non-optimal addition amount of the material.

Yet another embodiment includes: sufficiently mixing metered material with one or more activating agents to activate material in a mixer coupled to the unit and (1) corrective action which includes introducing, during a subsequent basic cycle time, an amount of the material which is greater than the addition amount, (2) corrective action which includes introducing, during a subsequent basic cycle time, an amount of the material which is less than the addition amount, (3) corrective action which includes extending the duration of the first period and shortening the duration of the second period of the given basic cycle time in order to introduce material into the one or more respective units during the given basic cycle time in an amount which is greater than the addition amount, (4) corrective action which includes returning to use of the addition amount of the material in a basic cycle time subsequent to a basic cycle time in which the corrective action is taken, (5) corrective action which includes continued use of an amount of the material which is different from the addition amount in each basic cycle time period remaining in the given period of time, (6) use of a corrective action which includes production of an alarm to alert an operator of the one or more respective units.

The Following Examples are for Illustration and not Limitation Dependent or Independent Relationship Between a Plurality of Materials Delivered to Respectively Same or Separate Units In an embodiment, material A catalyst such as 19.2 kg per day is mixed with activating agent such as ethanol provided at a rate such as 0.1.9 cubic meters/hr. In an embodiment, ratio of 167.8 kg of catalyst per cubic meters of methanol. In an embodiment, sufficient activated catalyst is provided to a unit to yield 110,000 cubic meters of product per year.

The control module is set to know that an amount of material A and amount of material B needs to be dispensed to the respective unit(s). If the amount of material A or B is changed, the control module may be programmed to maintain the relative proportion of material A to B.

1 Unit (Such as Unit)

In the 1 unit example, assume that material A is changed to 68 kg/day from the current 45.3 kg/day. If the 10% ratio of material B to material A is to be maintained, then the material delivery system needs to increase the addition of material B to 6.8 kg/day. The change may be performed manually, or the control module can make the calculation and make the change automatically.

In the 1 unit example, assume that material B is increased by 10%. If the ratio of material B to material A is to be maintained, then the material delivery system needs to increase the addition of material A in proportion to the increase in B. The change may be performed manually, or the control module can make the calculation and make the change automatically.

In an embodiment, material A such as Catilin Catalyst Series T300™ is added at a rate of 30-50 lb/day and material B, a catalyst additive, is added at a rate of 3-5 lb/day to the same unit 1. The above process description is set-up to perform this type of operation sequence. The control module is set to know that 30-50 lb/day of material A and 3-5 lb/day of material B is needs to be delivered to the respective unit. If the amount of material A or B is changed, the control module may be programmed to maintain the relative proportion of material A to B.

2 Units

In an example of 2 separate units, a given material such as A or B may be changed independently of the other material that is dispensed to 2 respectively separate units. For example, even though material A being dispensed to unit 1 may be changed to 68 kg/day from the current 45.3 kg/day, amount of material B being dispensed to unit 2 may be maintained as is.

In one embodiment, a processor would like to maintain a specific measure of product quality in one of the products or by-products from the biofuels reactor. The control module can make appropriate changes in the delivery rate of a quality modifying additive to a plurality of units from a single delivery system based upon input of an analytical measurement of product quality from each reactor to maintain this quality at a desired level. The control module can make the appropriate changes on a routine, continual basis, or just during emergency peak periods, such as when the product quality reaches a certain trigger level, for each respective unit. In this way, the processor can maintain product within the desired quality specifications while utilizing less material B while not having to outlay the capital for a dedicated delivery system for each unit.

The following Table 1 is an embodiment of some permutations of combinations of 4 types of materials which can be delivered to 2 units, respectively unit 1 and unit 2. There is virtually an infinite permutation of combinations of the type of materials and the respective quantities of a given material which can be delivered to one or more respective units, either individually or in a combination of two or more materials to one or more units thereof sequentially or simultaneously.

TABLE 1

| | unit | unit | unit | unit | unit | unit | unit | unit |
|---|---|---|---|---|---|---|---|---|
| Material A | 1 | 2 | 1 | 1 | 1 | 2 | 2 | 2 |
| Material B | 1 | 2 | 1 | 1 | 2 | 1 | 2 | 2 |
| Material C | 1 | 2 | 1 | 2 | 2 | 1 | 2 | 2 |
| Material D | 1 | 2 | 2 | 2 | 2 | 1 | 1 | 1 |

Although the teachings of the present invention have been shown and described in detail herein, those skilled in the art can readily devise other varied embodiments that still incorporate the teachings and do not depart from the scope and spirit of the invention.

While the invention has been described in detail in connection with only a limited number of aspects, it should be readily understood that the invention is not limited to such disclosed aspects. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A catalyst delivery system comprising:

a delivery vessel configured to dispense a metered amount of catalyst to at least one unit;

a metering device and one or more sensors which provides a metric indicative of the amount of catalyst passing through the metering device from the delivery vessel to the at least one unit;

at least one dispense mechanism configured to couple the delivery vessel to the at least one unit;

a mixer comprising a mixing element coupled to the delivery vessel and configured to sufficiently mix the catalyst with an activating agent, wherein the mixer is coupled to the unit;

a control module having a communication device operable to communicate with a remote device; and a hazardous location control substation having a specific purpose processor disposed in an explosion-proof enclosure remote from the control module, the hazardous location control substation coupling one or more sensors of the dispense mechanism to the control module, the specific purpose processor operable to convert signals from one or more sensors of the dispense mechanism into a form utilizable by the control module to determine the metric indicative of the dispensed catalyst.

2. The catalyst delivery system of claim 1, wherein the at least one unit comprises a biofuel unit.

3. The catalyst delivery system of claim 1, wherein the delivery vessel is configured to dispense catalyst to a plurality of units.

4. The catalyst delivery system of claim 1, wherein the mixer comprises a motor.

5. The catalyst delivery system of claim 1, further comprising a plurality of separate material storage containers coupled to the delivery vessel respectively via a plurality of inlets, a respective one of each inlet coupled to a separate material storage container.

6. The catalyst delivery system of claim 5, further comprising a plurality of load cells, respectively one of each load cells coupled to a respective compartment to provide a metric indicative of an amount of catalyst dispensed from each compartment of the delivery vessel to the unit.

7. The catalyst delivery system of claim 1, wherein the catalyst delivery system comprises self contained mobile material delivery system.

* * * * *